US010076826B2

(12) United States Patent
Meana-Esteban et al.

(10) Patent No.: US 10,076,826 B2
(45) Date of Patent: Sep. 18, 2018

(54) METHOD TO PROVIDE AN ABRASIVE PRODUCT SURFACE AND ABRASIVE PRODUCTS THEREOF

(71) Applicant: KWH MIRKA LTD, Jeppo (FI)

(72) Inventors: Beatriz Meana-Esteban, Jakobstad (FI); Göran Höglund, Nykarleby (FI); Hans Hede, Vörå (FI); Markus Kass, Bennaäs (FI); Mats Sundell, Hirvlax (FI)

(73) Assignee: KWH MIRKA LTD, Jeppo (FI)

( * ) Notice: Subject to any disclaimer, the term of this patent is extended or adjusted under 35 U.S.C. 154(b) by 305 days.

(21) Appl. No.: 14/837,985

(22) Filed: Aug. 27, 2015

(65) Prior Publication Data

US 2016/0001423 A1 Jan. 7, 2016

Related U.S. Application Data

(62) Division of application No. 14/770,689, filed as application No. PCT/FI2013/050216 on Feb. 26, 2013, now Pat. No. 9,616,551.

(51) Int. Cl.

| | |
|---|---|
| ***B24B 37/24*** | (2012.01) |
| ***B24D 11/04*** | (2006.01) |
| ***B24B 37/26*** | (2012.01) |
| ***B24D 3/28*** | (2006.01) |
| ***B24D 11/00*** | (2006.01) |
| ***B24D 11/02*** | (2006.01) |
| ***B24D 3/00*** | (2006.01) |

(52) U.S. Cl.

CPC ..... *B24D 11/04* (2013.01); *B24B 37/245* (2013.01); *B24B 37/26* (2013.01); *B24D 3/002* (2013.01); *B24D 3/28* (2013.01); *B24D 11/00* (2013.01); *B24D 11/005* (2013.01); *B24D 11/02* (2013.01)

(58) Field of Classification Search

CPC ..... B24D 3/28; B24D 11/00; B24B 37/24; B24B 37/26

USPC ..... 451/527, 526, 533, 534; 51/293, 297, 51/298

See application file for complete search history.

(56) References Cited

U.S. PATENT DOCUMENTS 5,628,862 A * 5/1997 Yu ..... B23H 5/08 156/345.12

5,709,598 A 1/1998 Nishio et al.

(Continued)

FOREIGN PATENT DOCUMENTS

CN 103079768 A 5/2013

JP U-33-7894 U 11/1958

(Continued)

OTHER PUBLICATIONS

Oct. 25, 2106 Office Action issued in Japanese Patent Application No. 2015-559530.

(Continued)

*Primary Examiner* — Robert Rose

(74) *Attorney, Agent, or Firm* — Oliff PLC

(57) ABSTRACT

The invention relates to obtaining an abrasive product comprising a surface with multiple abrasive zones supported by a backing layer. The abrasive zone are surrounded by interconnected channel portions comprising first channel portions with a first transverse dimension td1 and second channel portions with a second transverse dimension td2 larger than the first transverse dimension td1.

25 Claims, 15 Drawing Sheets

(56) References Cited

U.S. PATENT DOCUMENTS

| | | | | |
|---|---|---|---|---|
| 6,077,601 | A | 6/2000 | DeVoe et al. | |
| 6,634,929 | B1 | 10/2003 | Visser | |
| 8,470,061 | B2 | 6/2013 | Goldsmith et al. | |
| 8,883,288 | B2 | 11/2014 | Gaeta et al. | |
| 9,630,297 | B2 | 4/2017 | Janssen et al. | |
| 2002/0019199 | A1 | 2/2002 | Goers et al. | |
| 2002/0090901 | A1 | 7/2002 | Schutz et al. | |
| 2005/0164619 | A1 | 7/2005 | Soelch et al. | |
| 2006/0143989 | A1 | 7/2006 | Lindquist et al. | |
| 2009/0081932 | A1* | 3/2009 | O'Moore ..... | B24B 37/26 451/527 |
| 2012/0000135 | A1 | 1/2012 | Eilers et al. | |
| 2014/0308884 | A1 | 10/2014 | Janssen et al. | |
| 2015/0126098 | A1 | 5/2015 | Eilers et al. | |

FOREIGN PATENT DOCUMENTS

| | | | |
|---|---|---|---|
| JP | 2000-176828 | A | 6/2000 |
| JP | 2001-527468 | A | 12/2001 |
| JP | 2002-246343 | | 8/2002 |
| JP | 2003-103470 | A | 4/2003 |
| JP | 2004-519341 | A | 7/2004 |
| JP | 2008-526527 | A | 7/2008 |
| JP | 2010-045306 | A | 2/2010 |
| TW | 533229 | B | 5/2003 |
| WO | 9427787 | A1 | 12/1994 |
| WO | 9732693 | A1 | 9/1997 |
| WO | 01/04227 | A2 | 1/2001 |
| WO | 01/04227 | A3 | 1/2001 |
| WO | 0232626 | A1 | 4/2002 |
| WO | 2011/087653 | A1 | 7/2011 |

OTHER PUBLICATIONS

Jul. 5, 2016 Office Action Issued in U.S. Appl. No. 14/770,689.
Dec. 14, 2016 Office Action issued in Taiwanese Patent Application No. 103106109.
Dec. 28, 2016 Office Action issued in Taiwanese Patent Application No. 103106111.
Jul. 16, 2015 International Preliminary Report on Patentablilty issued in International Patent Application No. PCT/FI2013/050216.
Apr. 8, 2015 Written Opinion of the International Preliminary Examining Authority issued in International Patent Application No. PCT/FI2013/050216.
Jan. 8, 2014 International Search Report issued in International Patent Application No. PCT/FI2013/050216.
Jan. 8, 2014 Written Opinion of the International Searching Authority issued in International Patent Application No. PCT/FI2013/050216.
Jan. 9, 2014 International Search Report issued in International Application No. PCT/FI2013/050217.
Jan. 9, 2014 Written Opinion of the International Searching Authority issued in International Application No. PCT/FI2013/050217.
Aug. 13, 2015 International Preliminary Report on Patentability issued in International Application No. PCT/FI2013/050217.
Apr. 13, 2015 Written Opinion of the International Preliminary Examining Authority issued in International Application No. PCT/FI2013/050217.
U.S. Appl. No. 14/770,697 in the name of Beatriz Meana-Esteban et al. filed Aug. 26, 2015.
Jan. 24, 2018 Office Action Issued in U.S. Appl. No. 14/770,697.
Jun. 19, 2018 Office Action issued in Japanese Patent Application No. 2017-145228.

* cited by examiner

METHOD TO PROVIDE AN ABRASIVE PRODUCT SURFACE AND ABRASIVE PRODUCTS THEREOF

FIELD OF THE INVENTION

This invention relates to the field of abrasive products, uses of abrasive products and method to obtain an abrasive product.

BACKGROUND OF THE INVENTION

Abrasive products are used to treat object surfaces. The object surfaces may comprise a variety of materials, such as wood, metal or polymer. The treating in general involves removal of material from the object surface to obtain desired object surface properties such as smoothness or roughness or a special structure. Different materials or applications may set different requirements for an abrasive product to function appropriately.

SUMMARY OF THE INVENTION

Depending on the purpose, an abrasive product may comprise different properties. The object surface and material to be abraded may set requirements for the abrasive product. In general, it is desired that an abrasive product has conformability and flexibility to adapt to the object surface for smooth and uniform abrasion results. At the same time the abrasive product should be efficient and long lasting. Further, a certain use of the abrasive product may set special requirements that should be identified.

An object of the invention is to provide an improved method to obtain an abrasive product having improved properties. A further object of the invention is to provide an abrasive product having such improved properties. The improved properties may be used in various applications to obtain better abrasive quality. The improved properties may further extend the life cycle of the product.

Multiple abrasive zones supported by a backing layer may be provided on an abrasive product surface such that each abrasive zone may be surrounded by interconnected channel portions. The channel portions may be arranged to have dimensions and a pattern such that the abrasive product comprises improved flexibility and abraded material may be efficiently conveyed away from the abrasive product surface. The channel portions may be provided with increasing levels and volumes to improve flushing of the abrasive product surface and conveying detached material efficiently away, which reduces the risk of clogging. An abrasive product may further be provided comprising at the same time both flexibility to conform to the objective surface and durability to withstand use in machine abrasion and/or hand abrasion.

A method to obtain such an abrasive product may comprise providing a backing layer and forming multiple abrasive zones supported by the backing layer, where each abrasive zone may be surrounded by interconnected channel portions having a transverse dimension, where the channel portions comprise first channel portions with a first transverse dimension and second channel portion with a second transverse dimension larger than the first transverse dimension. Further, a method to obtain an abrasive product may comprise providing a backing layer and forming repeating units of abrasive zones on the backing layer, where the repeating unit boundaries opposite to each other have congruent curvature to form a complementary pair to fit the repeating units together in a pre-emptying manner. Advantageously, the provided abrasion product may comprise a surface enabling unidirectional abrasion.

The flexibility of the abrasive product may be further improved by providing a backing layer comprising surface height deviations, such as recessed areas and elevated areas, which may be used for attaching an abrasive layer comprising abrasive zones on the backing layer. Alternatively, the abrasive zones may be provided on a substantially flat backing layer such that the surface deviation are formed by an abrasive layer comprising multiple abrasive zones surrounded by interconnected channel portions.

Objects and embodiments of the invention are further described in the independent and dependent claims of the application.

DESCRIPTION OF THE DRAWINGS

The drawings are schematic and may be out of perspective.

The drawings are intended for illustrative purposes.

Figure 1:
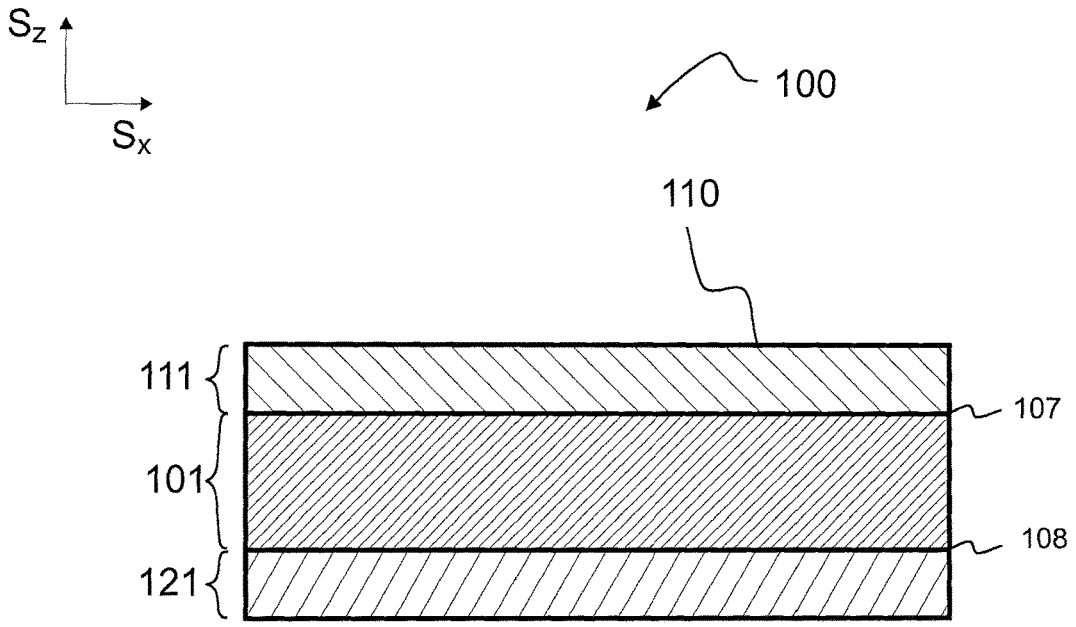

In the drawings and in the description, the symbols $S_x$, $S_y$ and $S_z$ represent orthogonal coordinate directions perpendicular to each other.

FIG. 1 represents a reduced example of an abrasive product structure.

Figure 2:
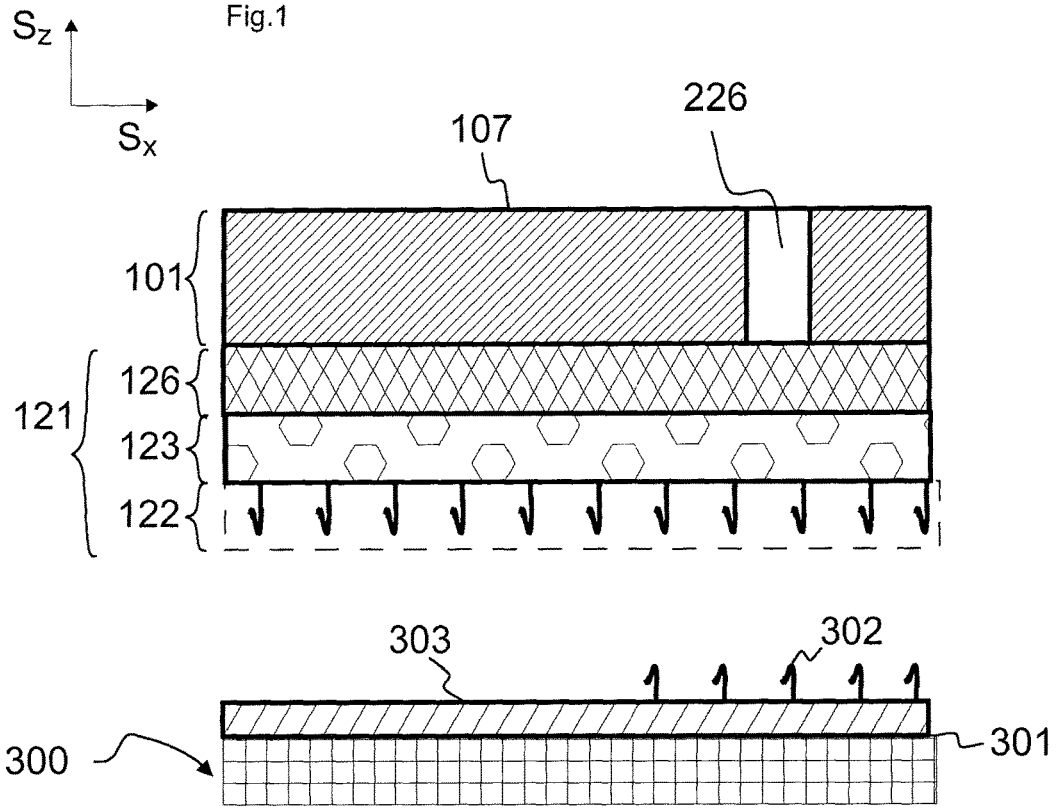

FIG. 2 represents a reduced example of an abrasive product structure attachable to an abrasive apparatus.

Figure 3:
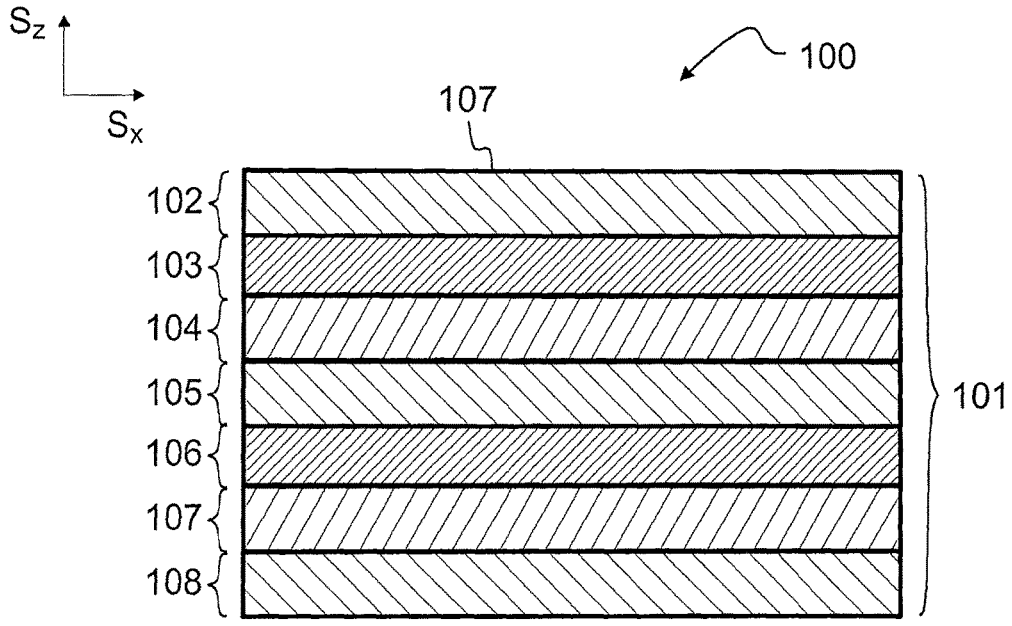

FIG. 3 represents a reduced example of a backing layer comprising different functional layers.

Figure 4B:
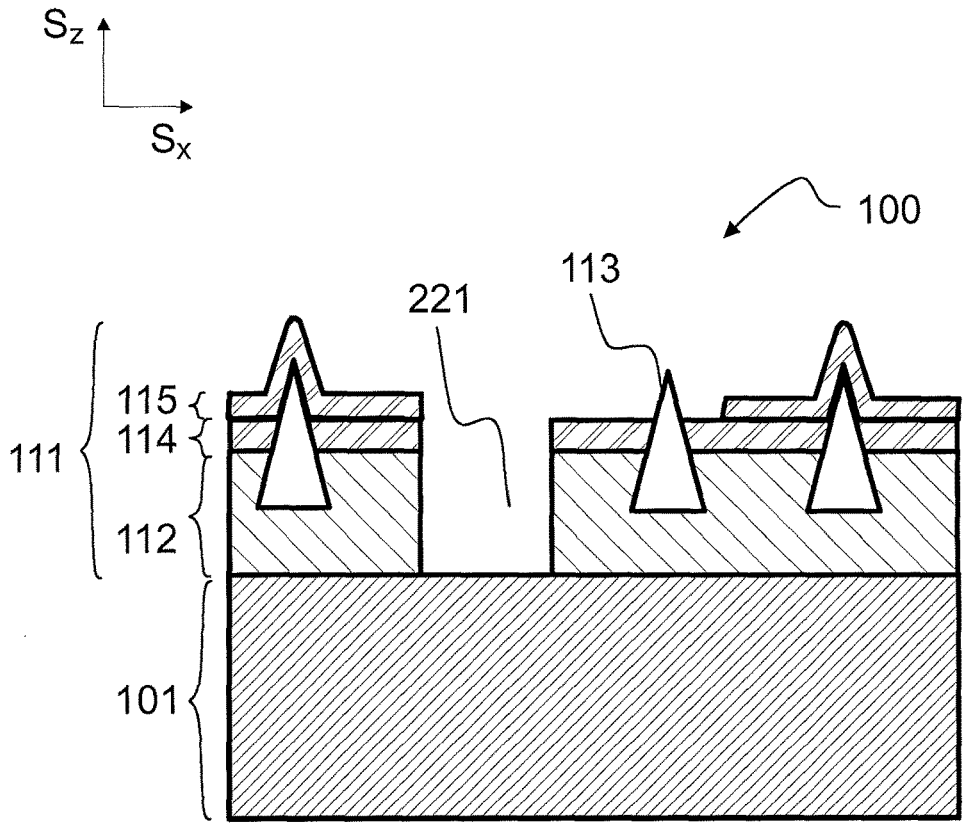
Figure 4A:
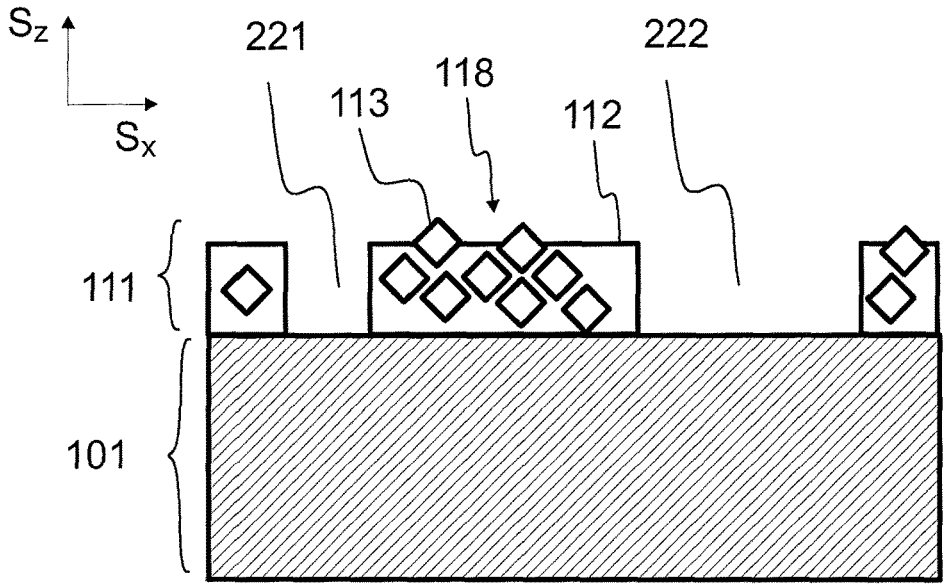
Figure 5:
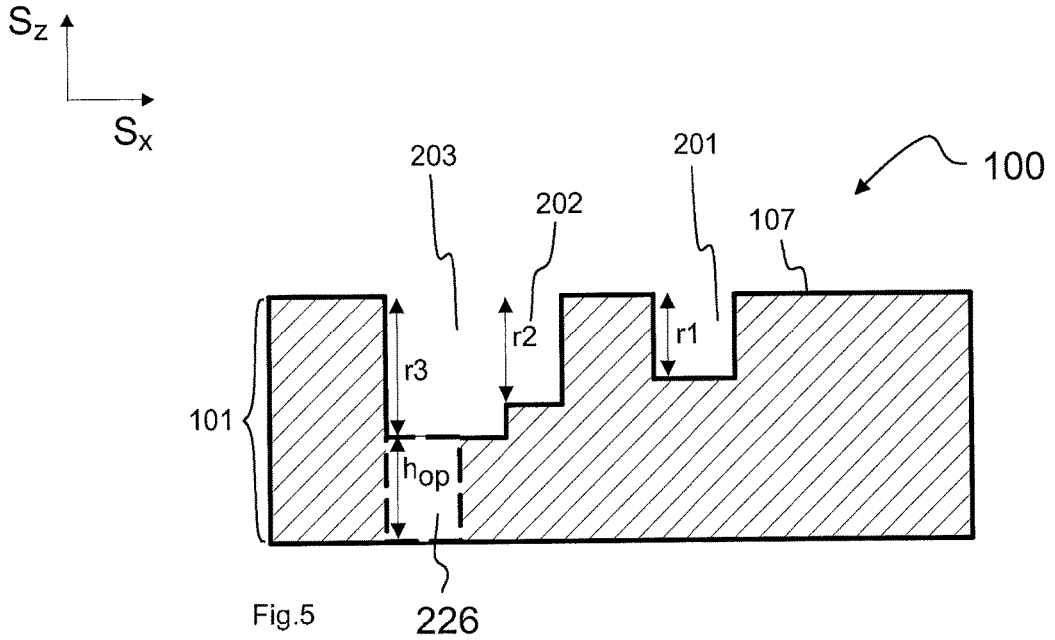

FIGS. 4*a* and 4*b* represent reduced examples of an abrasive layer structure FIG. 5 represents a reduced example of a backing layer structure comprising recessed areas.

Figure 6:
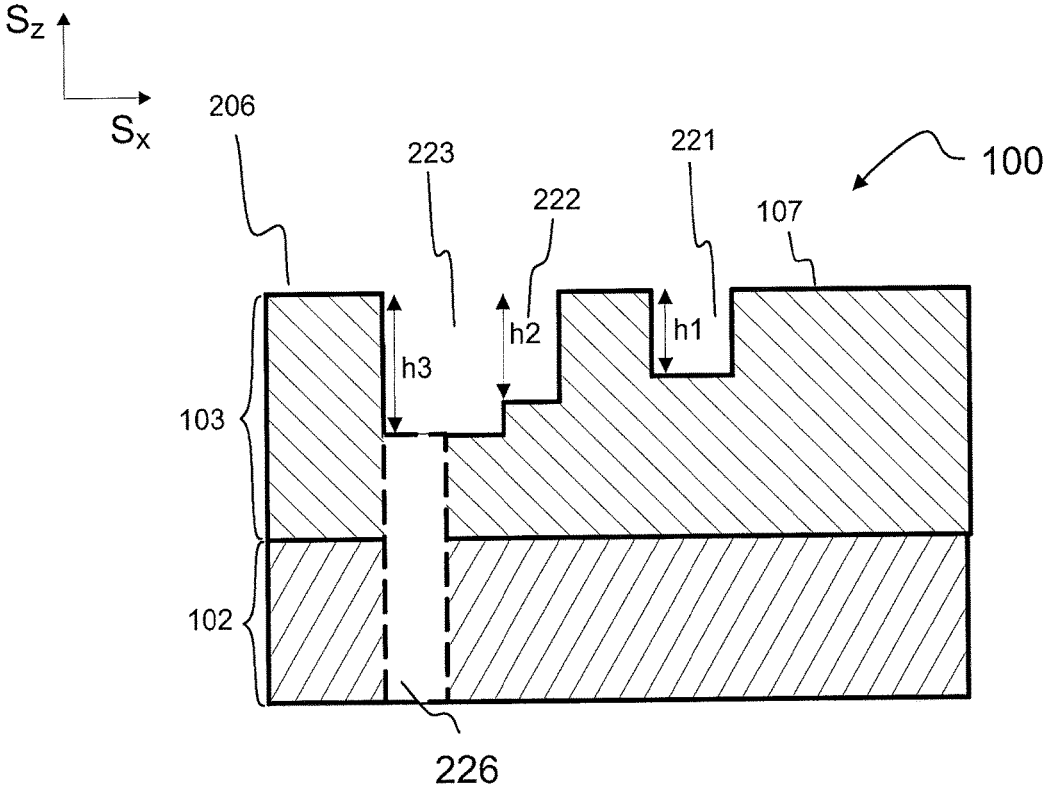
Figure 7:
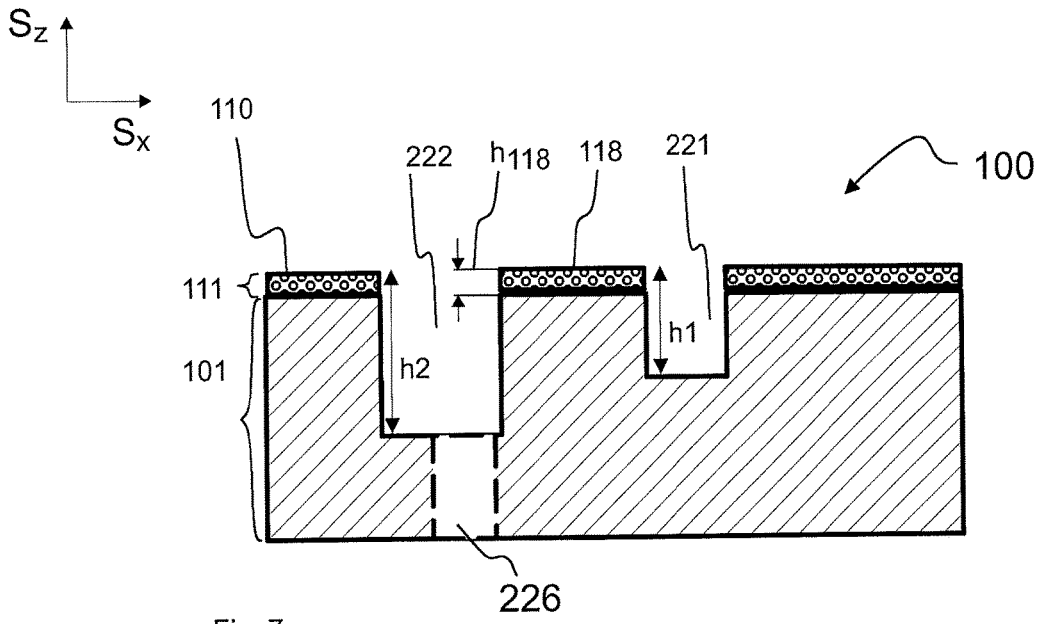

FIG. 6 represents a reduced example of a functional layer structure comprising recessed areas FIG. 7 represents a reduced example of an abrasive layer adjoined to a backing layer comprising recessed areas.

Figure 8:
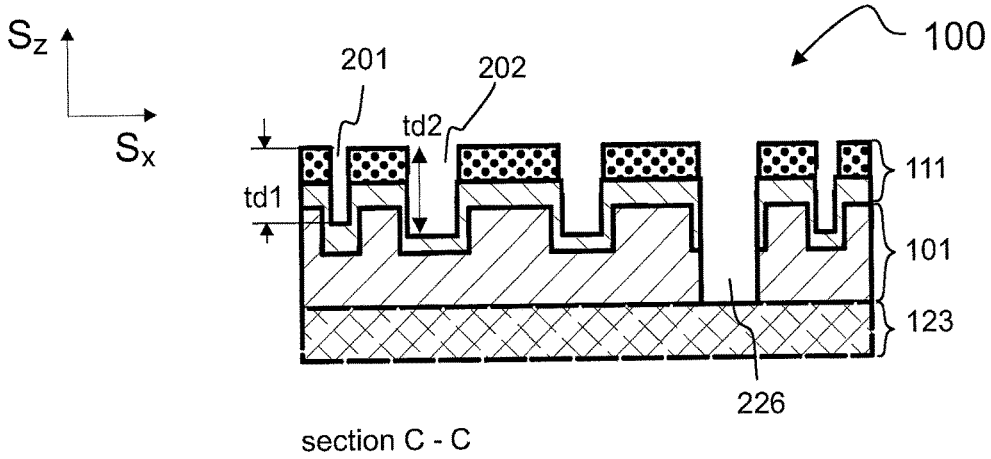

FIG. 8 represents a reduced example of a cross-section C-C of an abrasive product.

Figure 9:
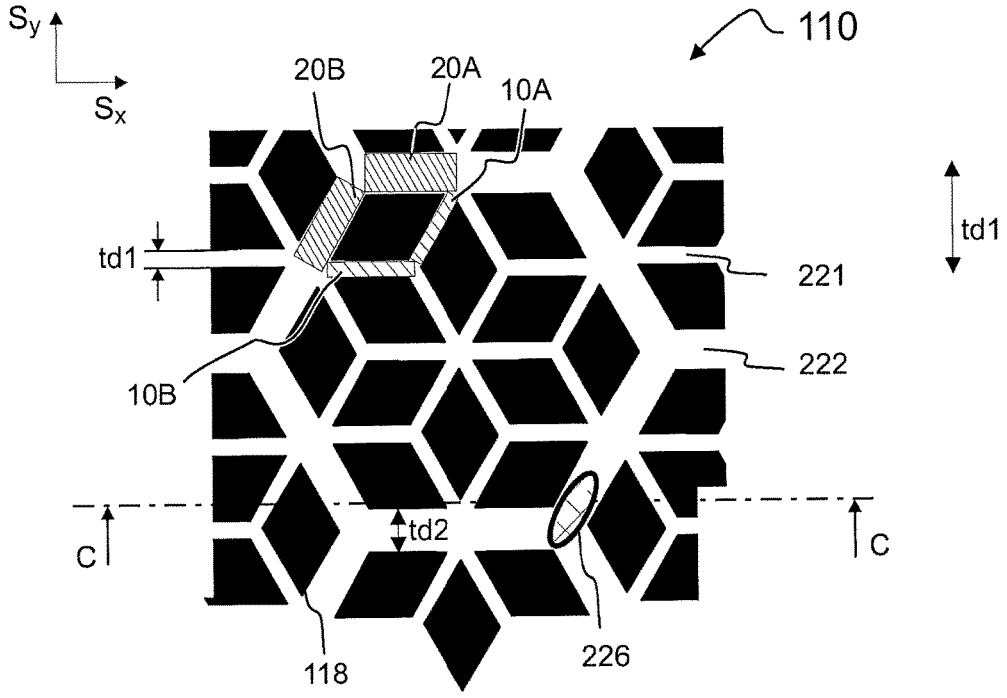

FIG. 9 represents a reduced example of an abrasive product from above.

Figure 10:
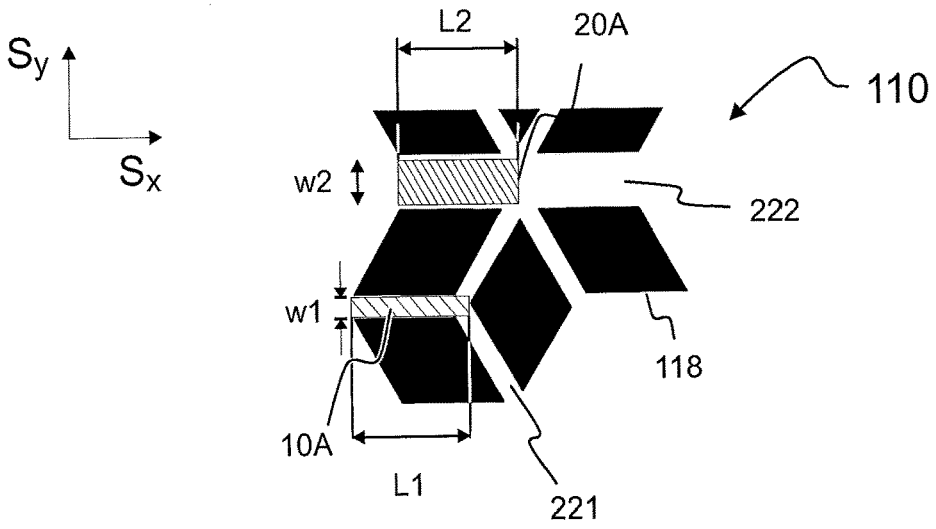

FIG. 10 represents a reduced example of an abrasive product surface comprising abrasive zones and channel portions.

Figure 11:
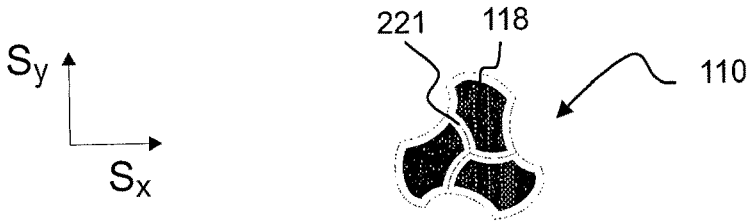

FIG. 11 represents a reduced example of channel portions comprising curvature.

Figure 12:
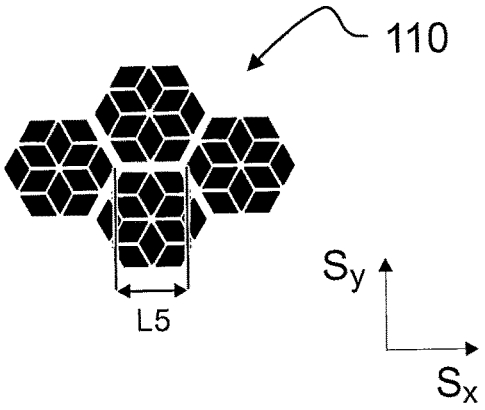

FIG. 12 represents a reduced example of second channel portions having a linear length.

Figure 13:
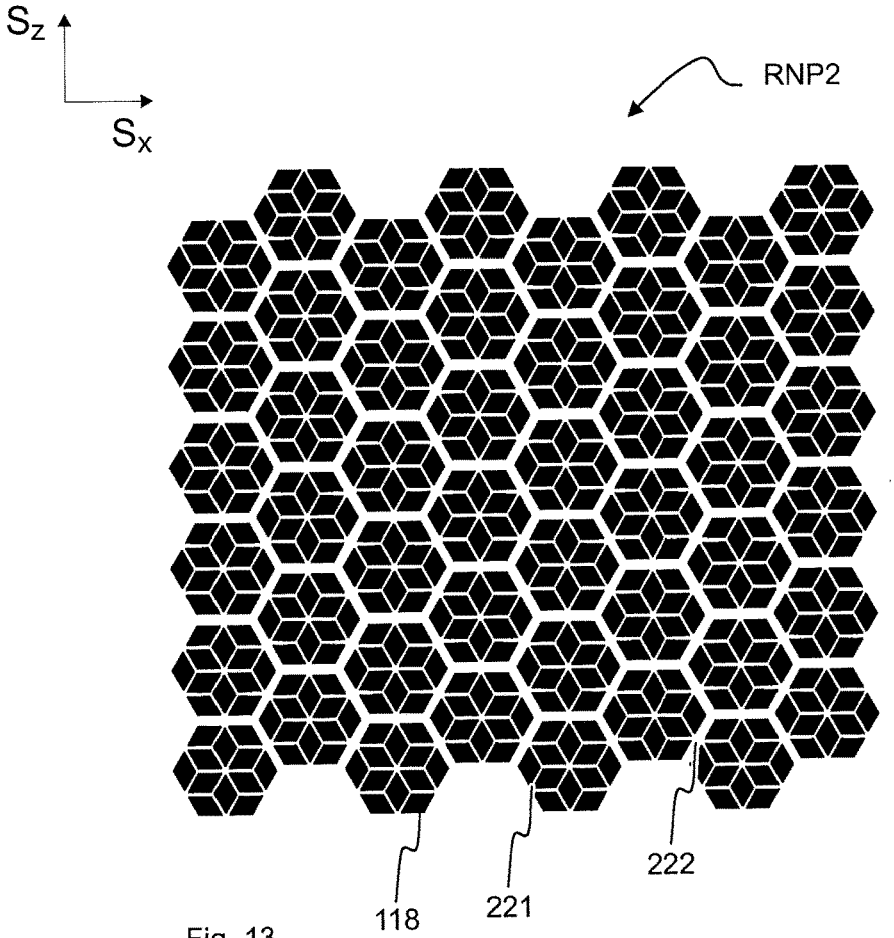

FIG. 13 represents a reduced example of a network of interconnected channel portions.

Figure 14:
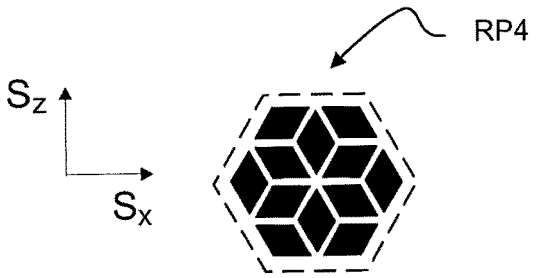

FIG. 14 represents a reduced example of an elementary pattern on an abrasive product surface.

Figure 15:
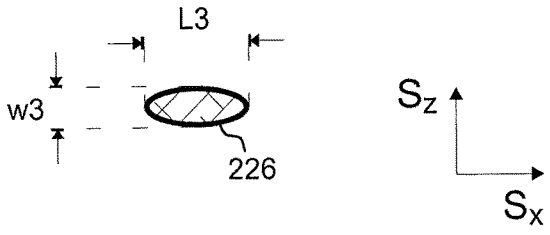

FIG. 15 represents a reduced example of an opening.

FIGS. 16*a* to 16*f* present a non-limiting example of deforming a geometric shape to provide elementary patterns on an abrasive product surface.

FIGS. 17*a* to 17*e* present a non-limiting example to provide elementary patterns on an abrasive product surface without deformation of the geometric shapes.

FIGS. 18*a* to 18*g* present another non-limiting example of deforming a geometric shape to provide elementary patterns on an abrasive product surface.

FIGS. 19*a* to 19*e* present a non-limiting example of a network of elementary patterns comprising angularity.

FIGS. 20*a* to 20*f* present another non-limiting example to provide a network comprising elementary groups and elementary patterns on an abrasive product surface.

FIGS. 21*a* to 21*e* present a further non-limiting example to provide a network comprising elementary groups and elementary patterns on an abrasive product surface.

Figure 22:
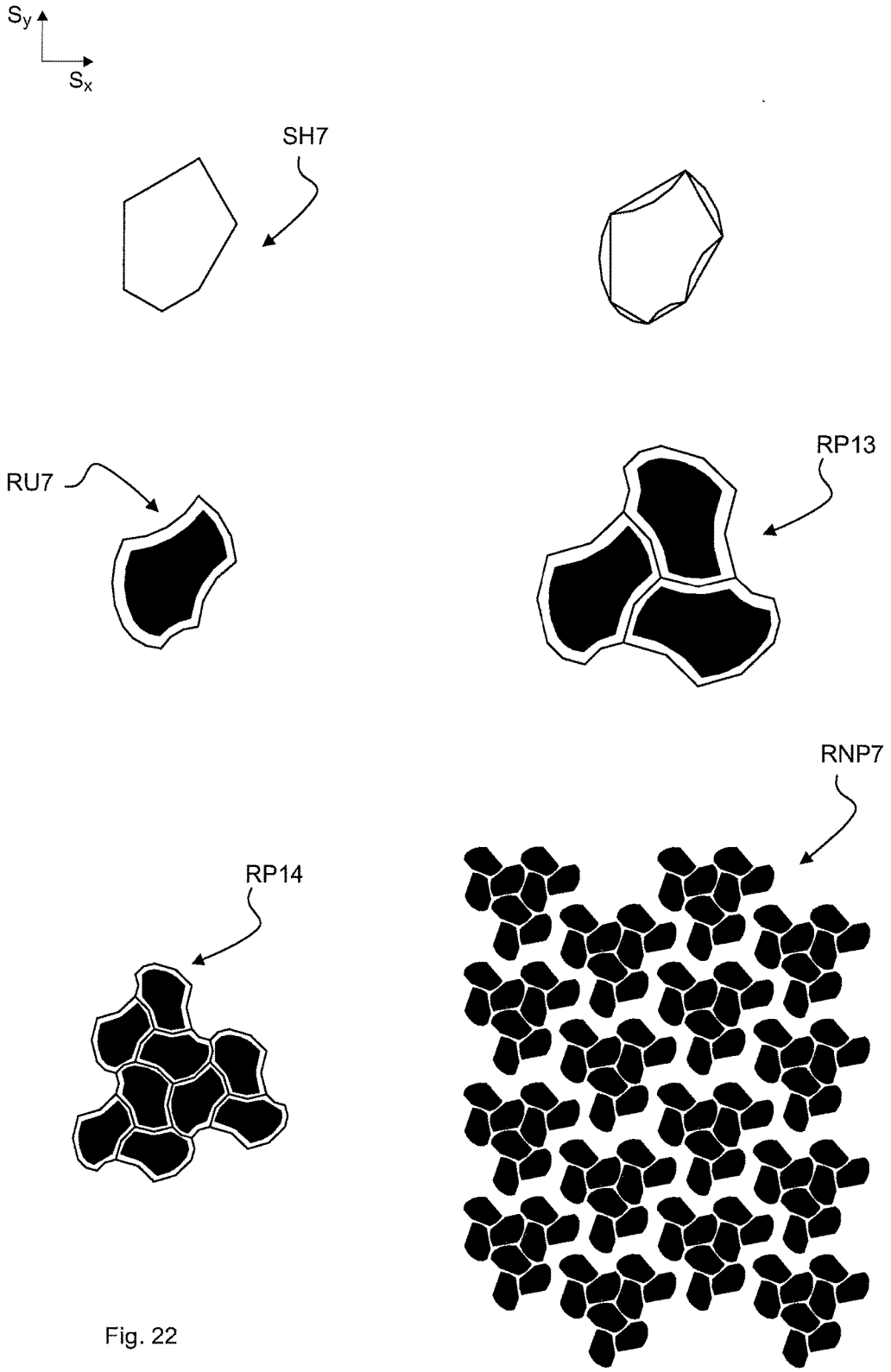

FIG. 22 presents a further non-limiting example to provide a network comprising elementary groups and elementary patterns on an abrasive product surface.

DETAILED DESCRIPTION OF THE INVENTION

Abrasive products may be used in different applications, such as automotive industry, ships and boats, building and construction sites, and composites industry, to name a few. The applications for abrasive products may further include various materials, such as wood, metal, composites, plastics, minerals or different coatings such as paints or varnishes. Removal of materials with different properties and behaviour may also require different properties from the abrasive product. Common abrasive methods may comprise for example grinding, polishing, buffing, honing, cutting, drilling, sharpening, lapping or sanding. The shape of the objects which require abrasion may vary. When the object surface shape is not planar and comprises height deviations, it is desirable that the abrasive product is flexible. A flexible abrasive product adapts better to the shape of the object surface being abraded. A typical drawback of a rigid abrasive product is that one part of the abrasive product may be pressed against the object surface harder than another part, which may produce uneven quality, in other words, some places may be abraded while others may be abraded less or not at all. Advantageously, the strength, shear stress, impact stress and modulus of elasticity of the adhesive product should be designed to match the requirement of the application. Abrasive products may be used for example in wet or dry conditions, depending of the purpose.

In the description, the term "channel" refers to a recessed area flanking an abrasive zone. A channel comprises a width and a length and a height. The term "channel portion" refers to the shortest surface distance between two branching points or intersections of a channel between two abrasive zones, denoted as "channel portion length". A channel portion has a substantially constant width and height along the channel portion length.

FIG. 1 shows a reduced example of an abrasive product 100 having a surface 110 with abrasive properties. The abrasive product 100 comprises a backing layer 101 with a first side 107 and a second side 108, and an abrasive layer 111 adjoined to one side of the backing layer 101. The abrasive layer may be adjoined to the first side 107 or the second side 108 of the backing layer 101, or on both sides. The adhesive product 100 may comprise an optional support layer 121 having a front side and a back side. The front of the support layer 121 may be adjoined to the second side 108 of the backing layer 101, for example by lamination or adhesion.

FIG. 2 shows a reduced example of the support layer 121 having a front and a back side. The front side of the support layer 121 may be adjoined to the second side 108 of the backing layer 101. The support layer 121 may comprise an attachment improving layer 126 and a foam layer 123. The attachment improving layer 126 may be, for example a polymer film laminated to the backing layer or a layer improving mechanical attachment, for example a stick-on system or a grip attachment, such as Velcro. The attachment improving layer 126 may alternatively, or in addition, comprise a pressure-sensitive adhesive layer adjoined to the second side 108 of the backing layer 101. Alternatively, or in addition, the attachment improving layer 126 may comprise a friction coating. A friction coating may be used increase surface friction of the second side 108 of the abrasive product 100, if the second side 108 does not comprise an abrasive layer 111. For example, the product 100 may comprise a friction coating applied to the second side 108 of the backing layer 101. Advantageously, the friction coating may comprise friction increasing material in dot-like formations. For example, the friction increasing material may be arranged on a two-dimensional array of dots with areas free of the friction increasing material surrounding the dots. Experimentally it has been observed, that equal amount of friction coating applied as an array of or dots, for example by means of a screen printer, an engraved roller, an electrostatic coating unite or dropping from a metering belt or by a vibratory device in dot-like formations, may provide enhanced friction in a wet abrasive product 100. When the foam layer 123 is directly against the backing layer 101, an additional grip layer 122 may be attached to the side not facing the backing layer 101. The backing layer 101 may comprise openings 226 extending through the backing layer 101 in the direction $S_z$.

An apparatus 300 may comprise the abrasive product 100. The support layer 121 may be used to attach the abrasive product 100 to the apparatus 300, which may be a tool used for abrasion. The support layer 121 may be used to attach an apparatus 300 or a tool used for abrasion to the abrasive product 100. Alternatively, the support layer 121 may be used to remove the abrasive product 100 from an apparatus 300 or a tool used for abrasion. This enables an easy switching of an abrasive product 100 to another on a tool or apparatus comprising a surface 301 for attaching the abrasive product 100. The apparatus may comprise a means for attachment compatible for the abrasive product 100. Compatible means may be, for example an attachment improvement layer 301 having back side and a front side. The attachment improvement layer 301 may comprise a mechanical attachment system 302, such as hooks or velour, such as a Velcro system, a vinyl layer, or a pressure sensitive adhesive layer. The apparatus 300 may comprise, for example means for linear machine abrasion or spinning machine abrasion. The apparatus 300 may comprise means for oscillation, such as a shaft and a support pad comprising the surface 301.

FIG. 3 shows a reduced example of a structure of the backing layer 101. A backing layer 101 may be manufactured to provide functionality. Functionality may be introduced by manufacturing a backing layer 101 comprising one or more functional layers 102, 103, 104, 104, 105, 106, 107, 108 having a first side and a second side. The first side of a first functional layer 102, 103, 104, 104, 105, 106, 107, 108 may be adjoined to the first or second side of a second functional layer different from the first functional layer. The functional layers 102, 103, 104, 104, 105, 106, 107, 108 may be adjoined for example by lamination or co-extrusion. For example, the abrasive product 100 may comprise a first functional layer 102 adjoined to a second functional layer 103 or a third functional layer 104. Therefore, the backing layer 101 may comprise more than one adjacent layers, such as two, three, four, five, six or seven adjacent layers. The functional layers may be formed in a manner similar to the backing layer 101. Some of the functional layers may have the same chemical composition. Alternatively, the chemical composition of each functional layer may vary. Further, the thickness of each functional layer may be the same or differ from one another. The functional layers 102, 103, 104, 104, 105, 106, 107, 108 may comprise layers with different functions, for example embossing layers, anti-static layers, such as ultraviolet light or radical (UV/EB) blocking layers, adhesion promoting layers, anti-slip layers, reinforcement layers or filler layers. A number of functional layers can be the same, that is, a backing layer 101 may comprise two or more functional layers 102, 103, 104, 104, 105, 106, 107, 108 identical to each other in chemical composition and/or thickness. One functional layer may comprise more than one function. Examples of different functional layers 102, 103, 104, 104, 105, 106, 107, 108 that may be part of the backing layer 101 are given below. The examples 1 to 9 may be used alone or may be combined. In particular, a functional layer 102, 103, 104, 104, 105, 106, 107, 108 may be combined with another functional layer 102, 103, 104, 104, 105, 106, 107, 108.

EXAMPLE 1

A functional layer 102, 103, 104, 104, 105, 106, 107, 108 may be a foam layer 123. A foam layer 123 may comprise, for example polyester, polypropylene, polystyrene or polyethylene. The foam layer 123 may comprise a porous structure, provided by a gaseous substance, or expanding additives. For example, a foam layer 123 may be formed with the help of a suitable gas, such as carbon dioxide. Alternatively, additives expanding or releasing gaseous compounds when heated may be used to form the pores.

EXAMPLE 2

A functional layer 102, 103, 104, 104, 105, 106, 107, 108 may comprise an embossing promoting layer. An embossing promoting layer may comprise a thermoplast, for example a polyvinyl alcohol, polyvinylchloride, (PVC), polypropylene (PP) or polyethylene (PE). An embossing layer may be used, for example, to provide a top surface 107 with surface height deviations.

EXAMPLE 3

A functional layer 102, 103, 104, 104, 105, 106, 107, 108 may comprise an antistatic layer. The backing layer 101 may be designed with an antistatic functional layer 102, 103, 104, 104, 105, 106, 107, 108 to provide good static performance to avoid sparks that can damage products or ignite solvent vapors or to avoid sheet sticking or to avoid dust attraction. Materials that may be used to dissipate statics and thus minimize static charging comprise polymeric additives, salts, conductive polymers, fibers and particles or fillers, surfactants, charge control agents, carbon nanotubes, carbon black or mica.

EXAMPLE 4

The backing layer 101 may comprise a UV/EB blocking functional layer 102, 103, 104, 104, 105, 106, 107, 108 to protect the material from degradation effects from light, ultraviolet light and/or radicals, such as free radical compounds. Examples of compounds of UV/EB stabilizers suitable for the UV/EB blocking layer comprise benzophenones, benzotriazoles, salicylates, acrylonitriles, hindered amines like different derivates of 2,2,6,6,-tetramethyl piperidine, or other polymers containing aromatic rings in their structure, pigments such as carbon black or titanium oxide to just name a few. The UV/EB stabilizers are very efficient at low concentrations.

EXAMPLE 5

A functional layer 102, 103, 104, 104, 105, 106, 107, 108 may comprise an attachment improving layer 126 such as an adhesion promoting layer; polypropylene binds poorly to different resins since it is a non-reactive polymer. In order to improve the binding polar functional groups may be introduced by different substrate treatments. The surface treatments include corona discharge, plasma etching, flame treatment, an adhesion layer graft onto the polypropylene backbone in the melt during extrusion. The adhesion promoting layer may comprise adhesion promoting compounds, such as one or a combination of the following: acid copolymer, sodium ionomer, zinc ionomer, or other metal ionomers such as Surlyn ionomers, low or high density polyethylene, ethylene vinyl acetate (EVA copolymer), ethylene acrylates ester copolymers including butyl acrylate (EBA copolymer), methyl acrylate (EMA copolymer) and 2-ethyl hexyl acrylate (2HEA), ethylene vinyl acetate terpolymers which are random ethylene, vinyl acetate, maleic anhydride terpolymers, ethylene acrylic ester terpolymers including different combinations of an acrylic ester type (methyl, ethyl or butyl acrylate) and monomer like maleic anhydride (MAH), glycidyl methacrylate (GMA). In other words, a functional layer (102, 103, 104, 104, 105, 106, 107, 108) may comprise an adhesion promoting compound selected from the group consisting of high density ethylene copolymer, low density ethylene copolymer, ethylene-butyl acrylate (EBA) copolymer, ethylene vinyl acetate (EVA) copolymer, ethylene methyl acrylate (EMA) copolymer, ethylene butyl acrylate (EBA) copolymer, 2-ethyl hexyl acrylate (2EHA) copolymer, ethylene acrylic ester terpolymer where the acrylic ester type is a methyl, ethyl or butyl acrylate, ethylene vinyl acetate terpolymer where the acrylic ester type is a methyl, ethyl or butyl acrylate.

EXAMPLE 6

A functional layer 102, 103, 104, 104, 105, 106, 107, 108 may comprise an antislip layer: The backing material may be designed with an antislip functional layer 102, 103, 104, 104, 105, 106, 107, 108 to enhance the coefficient of friction. The functional layer may be formed by any soft tacky rubbery coatings, or/and by any filler dispersed in a suitable binder material and applied in a separate process onto the backing material as an even or structrured coating. The fillers of choice can also be introduced in the melt during the extrusion process. Aluminum oxide, fumed silicate-type particles, calcium carbonate and silicon dioxide, are examples of materials that may be used for antislip purposes.

EXAMPLE 7

Reinforcing layer (reinforcing fillers): This functional layer may contribute to optimize the mechanical properties of a product 100 in a dedicated application. Different types of fillers can be used for this purpose, for example materials which increase the mechanical strength. Examples of fillers include glass fiber, graphite fiber, aramid fiber, carbon fiber, nanocelullose, carbon nanotubes, calcium carbonate, talc, caolin and mica. Different fillers can be used alone or in combination. The fillers may be used to modify the mechanical properties of the functional layer 102, 103, 104, 104, 105, 106, 107, 108 or the backing layer 101. However, the fillers may further be used to modify different properties such thermal expansion, optical properties, thermal stability, antislip properties or electrical properties such as antistatic properties.

EXAMPLE 8

Die cutting promoting layer: Examples of materials used in this functional layer are polycarbonate, acrylic, uretane, epoxy.

EXAMPLE 9

Lamination or "fastening" system layer: This layer may be formed by any polymer containing groups which react with heat or other chemicals acquiring glue-like properties. In particular, compounds referred to in the adhesion promoting layer may be used for lamination to attach two adjacent layers together. Lamination may be used as an advantageous method for attaching functional layers 102, 103, 104, 104, 105, 106, 107, 108 together.

FIGS. 4*a* and 4*b* show reduced examples of a structure of an abrasive layer 111. The abrasive layer 111 comprises abrasive material to abrade an object surface. The abrasive layer 111 may comprise abrasive zones 118 surrounded by interconnected channel portions 221, 222. The abrasive zones comprise the abrasive material.

An abrasive product 100 refers to an article which may be used for abrasion. The abrasive product 100 may be shaped from an abrasive sheet. An abrasive sheet may comprise multiple abrasive products 100. The abrasive product 100 may be shaped from the abrasive sheet by any known method. An exemplary way to form an abrasive product from an abrasive sheet is by die-cutting. An abrasive product 100 may be formed from an abrasive sheet, advantageously by using a laser technique to obtain an abrasive product 100 with a desired shape. An abrasive product 100 may also be manufactured such that moulding is used for obtaining the shape of an abrasive product 100.

The surface 110 in general comprises abrasive material, such as abrasive grains 113 adjoined to a resin 112. Typical materials used as abrasive grains 113 are hard minerals, which may be synthetic or occur naturally. An exemplary list of minerals used as abrasive grains 113 comprises cubic boron nitride, boron carbide
aluminium oxide,
iron oxide,
cerium oxide
silicon carbide,
zirconia alumina and
diamond Furthermore, abrasive grains 113 may comprise ceramic grains or engineered grains.

The resin 112, denoted as a make coat, may be a mixture, where abrasive grains 113 are mixed to the resin 112. FIG. 4*a* shows an example of a mixture, denoted as abrasive slurry, which may be deposited on the backing layer 101 and cured by means of heat or radiation to form an abrasive layer 111. FIG. 4*b* shows an example of another way to obtain an abrasive layer 111, where an abrasive layer 111 may be coated such that the abrasive grains 113 may be oriented to the make coat layer comprising resin 112, for example by means of gravity or electrostatic coating and then fixed by a second size coat 114 layer that might be equal or different to the make coat layer comprising resin 112. These two methods differ from each other, as the abrasive slurry comprises abrasive grains 113 in multiple layers of, whereas the coating layer only comprises substantially a monolayer of abrasive grains 113 advantageously oriented such that sharp ends of the abrasive grains point to a substantially opposite direction from the backing layer 101. The abrasive layer may further comprise a size coat 114 for improving the attachment of the single layer of abrasive grains 113. Further still, a supercoat 115 may be applied on top of the size coat 114 to shield the abrasive grains 113. A single layer of abrasive grains may be manufactured to be durable. In other words, the attachment of the abrasive grains on the backing layer 101 may be stronger. A stable abrasive layer 111 may enable more precise abrasion. When using slurry comprising abrasive grains, the formation of abrasive areas in general comprises multiple layers of abrasive material. When used, the abrasive material starts to erode and wears off, which detaches abrasive grains and adhesive material, and reveals new abrasive grains from beneath. The detached abrasive material may be loose on the object surface and may, for example, be either stuck on the object surface or on the abrasive layer, causing uneven abrasion pattern to the object surface. This may be observed as scratches. By using an abrasive layer 111 comprising a substantially single layer of resin 112 and abrasive grains 113 which may comprise orientation, the abrasion procedure may be better controlled. The figures are not on any scale; therefore the abrasive layer 111 may have a substantially planar surface.

The abrasive product 100 comprises a backing layer 101. The backing layer 101 may comprise a first side 107 and a second side 108. The backing layer 101 may comprise variety of materials such as paper, cloth or a polymer. The backing layer may comprise an injection moulded object, such as a metal, polymer or a composite object. The backing layer 101 may be a sheet or a film. The film may be in the form of a film web on a roll. Alternatively, the backing layer 101 may be an injection moulded article. The abrasive product may be adjoined to an apparatus used for machine abrasion. In particular, the abrasive product may be attached and removed, for example on a support.

The properties of the backing layer 101 may be selected based on the application. Hard object surface materials may require a durable and rigid abrasive product 100, whereas object surfaces having surface deviations or shape may require a more conformable abrasive product. Dampening of the abraded material prevents particles from becoming airborne dust. Airborne dust is detrimental and may cause health problems. Wet mode abrasion uses a fluid, such as water or a liquid comprising water to reduce the formation of dust. Wet mode may be used for abrasive products for which moisture is not a problem. In wet mode, the abrasive product and the surface may be dampened with a liquid. The liquid may be water, water based liquid, an organic solvent, a polar or non-polar solvent or any combination of these. The use of a liquid enables flushing of the object surface and the abrasive surface 110 with water. Water may be used to bind abraded material detached from the object surface, denoted as swarf. Wet mode abrasion functions by washing the space between the object surface and abrasive product surface 110 with water and by conveying abraded material away. For wet mode abrasion to be effective, the space between the object surface and abrasive product surface 110 should retain sufficient amount of water such that the surface is abraded and that the abraded material or swarf is conveyed away. If the abraded material accumulates between the surfaces, the efficiency of the abrasion will decrease.

In general, paper, cloth or a polymer film may be used as a backing layer 101 material. However, for wet mode abrasion, paper as a backing layer 101 material poses challenges. For abrasion with water, the backing layer 101 material requires to be waterproof. Paper may be specially treated to such purposes. However, specially treated paper is an expensive material. Furthermore, the properties of paper material may vary between different production batches or even in the same batch, which may pose a challenge for the production quality of the abrasive product 100. A more problematic issue is that the characteristics of the paper material often change during the manufacturing of an abrasive product. Although a paper may be impregnated and barrier coated on both sides, the coating may not be i completely waterproof. Furthermore, the surfaces of the paper may not be completely flat. When soaking a product in water the paper may swell more than the coating layer and the product may curl. In particular, the paper may be conditioned to correct a curl after coating, but may curl again, for example when the humidity changes. The advantage of a polymer, such as a polypropylene, is that the curling may be less or it may be adjusted by heating. In comparison to paper, a polymer film may be stable after adjustment.

A polymer material may be more suitable as a material for the backing layer 101. An advantage of a polymer material is that polymers may be moulded and processed to a desired shape and thickness. Further, by selecting an advantageous polymer material, the backing layer 101 may be modified to comprise desired properties. The backing layer 101 defines the basic properties of the abrasive product 100. Advantageously, the backing layer 101 should be at the same time both flexible to conform for the objective surface and durable to withstand use in machine abrasion and/or hand abrasion. Durable in this respect refers to tensile strength and bending stiffness or elongation strength of the backing layer 101.

Advantageously the backing layer 101 may comprise a thermoplastic polymer. Thermoplastic polymers may be processed to layers by methods known to a person skilled in the art, such as extrusion, co-extrusion or injection moulding or lamination. Thermoplastic polymers may be formed to have a precise composition, are easy to mould and process and are thus advantageous to continuous providing of a backing layer 101 with even quality. A thermoplastic polymer may be melted and processed to a backing layer 101. Furthermore, the thermoplastic polymer may be selected to comprise a combination of elastic and plastic properties which are suitable for the application of the abrasive product being manufactured. When providing a backing layer 101 comprising a thermoplastic polymer, the thickness of the backing layer 101 may be selected. The thickness of the layer has an effect on the flexibility of the product. In particular, a backing layer comprising the same thickness but a different polymer may have a different property, such as flexibility.

Polyesters or polyolefins may be used as the backing layer 101 material for abrasive products 100. Both of these thermoplastic polymers are readily available commercially, and may be processed to a sheet or a film with a desired thickness. Further, both of these thermoplastic polymers are essentially watertight. Examples of polyesters and polyolefins suitable for backing layer 101 materials are polyethylene terephthalate (PET) and thermoplastic polyolefins, such as polyethylene (PE), polypropylene (PP), polymethylpentene (PMP) or polybutene-1 (PB-1). The melting temperatures and tensile strengths of these polymers are described in Table 1 below:

TABLE 1

Melting temperatures and tensile strengths of thermoplastic polyolefins and PET as generally given in the literature.

| Material | Melting temperature (° C.) | Tensile strength (MPa) |
|---|---|---|
| LD-PE | 115 | 8.3-31.4 |
| HD-PE | 137 | 22.1-31.0 |
| PMP | 235 | 25.5 |
| PB-1 | 135 | 36.5 |
| PP | 175 | 31.0-41.4 |
| PET | 265 | 48.3-72.4 |

The abrasive product 100 may be used as an attachable and removable object. An abrasive product 100 comprising a backing layer 101, made by extrusion, co-extrusion or die casting, typically comprises a thickness in the range of 50 micrometers to 5 millimeters. Advantageously the backing layer 101 is conformable in multiple directions $S_x$, $S_y$ and $S_z$. To provide the backing layer 101 a desired flexibility, the backing layer 101 thickness may advantageously be in the range of 70 to 250 micrometers. More advantageously, the thickness of the backing layer 101 is equal to or more than 90 micrometers or equal to or less than 200 micrometers.

As can be seen from table 1, polyesters in general have a higher melting point in the range of 250° C. to 270° C. than polyolefins. Furthermore, polyesters have a high stiffness. Thermoplastic polyester, such as polyethylene terephthalate (PET), for example, has a very high tensile strength. A backing layer 101 with a same thickness comprising polyester is less flexible than a backing layer 101 comprising a polyolefin, for example a polypropylene. In particular, an abrasive product 100 may need to be bended in multiple directions, such as towards the first side 107 and/or the second side 108 of the backing layer 101. The bending may be performed in three dimensions. In such situations a higher flexibility is an advantage. Advantageously, the backing layer 101 comprises a polymer that has both elastic and plastic properties and is compatible with other layers adjoined to the backing layer 101. Of the polyolefins, polypropylene comprises desired properties such as a suitable processing temperature of more than 120° C. The polypropylene may comprise a propylene homopolymer or a propylene copolymer. Polypropylene in this application refers to an alkene polymer wherein the alkene polymer might be a polypropylene homopolymer, random copolymer of propylene and ethylene or alternatively propylene and an alkene, a block copolymer of propylene and ethylene or alternatively propylene and an alkene. Propylene copolymers with alkenes up to C8 may be used. Among the preferred alkenes are C2-C4 alkenes, polypropylene being most preferred due to recyclability. Polyethylene and polypropylene are also available in high purity grades without residues that may interfere with the manufacturing process.

The backing layer 101 may be a single layer comprising only polypropylene. Polypropylene may also be a polymer blend, comprising polypropylene as the major ingredient and minor amounts of other polymer ingredients. For example, the polymer blend may also comprise a minor amount of non-polymeric additives, such as plasticisers or softeners. When the backing layer 101 is a multilayer structure, compositions of the different layers should be at least partially compatible with each other. The backing layer 101 may comprise a propylene homopolymer. In addition the backing layer may comprise propylene copolymers. Propylene copolymers may be used, for example, to reduce the stiffness of the backing layer. This may increase the flexibility of the abrasive product 100. In a multilayer structure, the backing layer 101 may comprise polypropylene at least 20%, preferably at least 50%, more preferably at least 60% or at least 70%. The backing layer 101 may comprise one or more functional layers 102, 103, 104, 104, 105, 106, 107, 108 which each may have a different composition. A functional layer 102, 103, 104, 104, 105, 106, 107, 108 may comprise, for example between 40% and 100% of polypropylene. Alternatively, a functional layer 102, 103, 104, 104, 105, 106, 107, 108 may comprise less than 100% of polypropylene, such as in the range of 5% to 99%. A backing layer 101 may comprise a structure of multiple layers, where at least one the functional layers 102, 103, 104, 104, 105, 106, 107, 108 does not comprise polypropylene. Percentages of polypropylene in each layer, such as the backing layer 101 or a functional layer 102, 103, 104, 104, 105, 106, 107, 108 are percentages by weight based on the total polymer weight of the backing layer 101. For example, the backing layer 101 may comprise between 40% and 100%, preferably at least 50%, of polypropylene of the total polymer weight of the backing layer 101. The flexibility of the backing layer 101 may be selected by choosing functional layers 102, 103, 104, 104, 105, 106, 107, 108 comprising different properties.

An abrasive product 100 may comprise a backing layer 101 with a first side 107 and a second side 108, wherein an abrasive layer 111 is adjoined to one side of a backing layer 101 comprising polypropylene. A backing layer 101 comprising polypropylene has a relatively low surface tension. To promote the attachment of an abrasive layer 111 to the backing layer 101, a corona, plasma or flame treatment may be used. Alternatively, an adhesion promoting layer may be used as a top layer of a backing layer 101 comprising multiple functional layers 102, 103,104, 105, 106, 107, 108. A multiple functional layer structure may comprise one or more layers, such as two or more layers. A method comprising a corona, plasma or flame treatment increases the surface tension of the treated surface, and may be performed on one or both sides 107,108 of the backing layer 101. Alternatively, adhesion promoting layers may be provided on one or one or both sides 107, 108 of the backing layer 101. Corona, plasma or flame treatments may be also used on top of the adhesion promoting layer. To further improve the attachment of the abrasive layer 111 to the backing layer 101. The abrasive layer 111 comprises an resin 112, and abrasive grains 113. The resin 112 be used to bind the abrasive grains to the surface 110 of the abrasive product 100. Polypropylene has a relatively low melting point temperature of less than 200° C., and depending of the structure of the used polypropylene may start to soften already at temperatures above 100° C. The relatively low melting point of polypropylene may have an effect on the curing method for the abrasive layer 111 adjoined to the backing layer 101. Advantageously, radiation curing is used for curing the abrasive layer 111. An abrasive layer 111 may be attached to a backing layer 101, which may comprise functional layer 102, 103,104, 105, 106, 107, 108. A functional layer adjacent to the abrasive layer 111 may comprise an adhesion promoting surface. The adhesion promoting surface may comprise compounds such as acrylate copolymer or ethylene-butyl acrylate (EBA). Further, the adhesion promoting surface may comprise a high density ethylene copolymer or low density ethylene copolymer, such as ethylene vinyl acetate (EVA), ethylene methyl acrylate (EMA), ethylene butyl acrylate (EBA) or 2-ethyl hexyl acrylate (2EHA) copolymer. Further still, the adhesion promoting surface may comprise an ethylene copolymer such as ethylene acrylic ester terpolymer, where the acrylic ester type may be a methyl, ethyl or butyl acrylate. Further still, the adhesion promoting surface may comprise an ethylene copolymer such as ethylene vinyl acetate terpolymer comprising random ethylene, vinyl acetate and maleic anhydride. In particular, the examples of adhesion promoting compounds given above may be used with surfaces comprising polypropylene, which in general has a low surface tension. Ethylene vinyl acetate EVA can be arranged to react with other functional polymers to create chemical bonds which may increase adhesion, heat resistance or long term ageing properties. In particular, the adhesion may be further improved by providing glycidyl methacrylate (GMA) or maleic anhydride (MAH) groups to the ethylene vinyl acetate EVA. Acrylic esters may be used to decrease the crystallinity of the backing layer polymers, which may widen the operating window of the adhesive promoting compound. Further, acrylic esters may improve the mechanical properties of the abrasive layer 111 or the backing layer 101. Therefore, the abrasive layer 111 or the backing layer 101 may comprise an adhesion promoting compound selected from the group consisting of high density ethylene copolymer, low density ethylene copolymer, ethylene-butyl acrylate (EBA) copolymer, ethylene vinyl acetate (EVA) copolymer, ethylene methyl acrylate (EMA) copolymer, ethylene butyl acrylate (EBA) copolymer, 2-ethyl hexyl acrylate (2EHA) copolymer, ethylene acrylic ester terpolymer where the acrylic ester type is a methyl, ethyl or butyl acrylate, ethylene vinyl acetate terpolymer where the acrylic ester type is a methyl, ethyl or butyl acrylate, or acid copolymer, sodium ionomer, zinc ionomer, or other metal ionomers such as Surlyn ionomers. The compounds may further provide thermal stability. Maleic anhydride may be used to increase the adhesion to polar substrates. Further, maleic anhydride may be used as a coupling agent for the creation of chemical bonds onto substrates such as fibers, polymers, or non-woven materials.

Conventionally, an abrasive product 100 comprising a backing layer 101 is flexed after forming the abrasive layer 111. The flexing is required due to the adhesive, which typically causes shrinking of the abrasive product 100. In particular, this is problematic when a paper or a cloth comprising fibres is used as a backing layer 101 material. The coating of a backing layer 101 comprising paper with a slurry comprising a resin 112 typically results to the paper being impregnated by the resin 112 to at least some extent. The resin 112 used for the abrasive layer 111 may not stay completely on the first side 107 or second side 108 of the backing layer 101, but may partially absorb into the fibres. When the resin 112 is cured, the formed abrasive layer 111 may harden and shrink. The abrasive product 100 may then turn more brittle and may crack easily. Further, the shrinking deforms the abrasive product 100, which makes it more difficult to handle and use. All fibrous woven and non-woven materials, such as paper and cloth, may pose similar drawbacks to at least some extent, as the adhesives impregnate to the fibres. An abrasive product 100 with a backing layer 101 comprising paper or cloth may need to be pre-treated to facilitate and improve the abrasion. In particular, an abrasive product 100 comprising a waterproof paper may need to be soaked several hours before performing tasks requiring precise abrasion. When the adhesive is cured, the surface 110 of the abrasive product may form a hard crust. The shrinking further causes buckling and curling to the abrasive product 100, which then needs to be stretched in multiple angles and directions to recover at least part of the flexibility of the backing layer 101 and to regain the shape of the abrasive product 100. The abrasive product 100 may be flexed by stretching it in a direction $S_x$ over multiple flexing rolls or bars in different directions, which break the abrasive layer 111 into small pieces. This straightens the abrasive layer 110 back into a substantially planar form and improves the flexibility of the abrasive sheet 100. However, the flexing operation only improves the flexibility of the abrasive layer 110 towards the second side 108 of the backing layer 101, which does not comprise an abrasive layer 111. Further, flexing does not improve bending of the abrasive sheet towards the abrasive layer 111. Further still, the flexing is an extra operation, which may increase the production costs, and may weaken the strength of the backing layer 101 and the abrasive product 100. A polypropylene film together with small abrasive zones surrounded by channels may provide an alternative for flexing by having flexibility in more than one direction. The abrasive zones may be separated by channels.

Furthermore, the flexibility and elasticity of the polypropylene film may provide separate small islands of hard abrasive coating to move in relation to each other. This may provide an abrasive product 100 which at the same time combines an abrasive layer 111 having a stable bonding and durable coating with a flexible backing layer 101. Such a product 100 may better preserve the advantageous characteristics of the components in the construct.

By selecting a polypropylene material for the backing layer 101 and optimizing the manufacturing method of the backing layer, the flexibility of the abrasive product is improved. Furthermore, a polypropylene material for the backing layer 101 removes the need for pre-treatment of the material by soaking. Further still, the backing layer 101 material may be selected and manufactured to provide functionality for the backing layer in more than one direction. The backing layer 101 may be formed for example, by extrusion, co-extrusion or injection moulding, to obtain a desired thickness for the layer 101. Co-extrusion may be used to adjoin more than one layer together, which has the effect to form a more stable attachment of adjoined layers compared to a lamination process. Co-extrusion provides sufficient adhesion between two layer surfaces without additional intermediate tie layer. Advantageously, the backing layer may be formed by die casting to diminish orientation of the backing layer 101 in machine direction or transverse direction. In die casting the stretching of the formed backing layer is minimal, which results to a backing layer with substantially symmetrical strength in both machine and transverse directions and a minimal shrinkage tendency. This has the advantage of obtaining an abrasive product with a unidirectional backing layer, enabling an abrasive layer with more freedom to design the abrasive surface 111. Advantageously, the backing layer 101 may comprise a substantially symmetrical tensile strength in the range of 1600 to 5000 N/mm$^2$ in both machine and transverse direction. More advantageously, in an abrasive product comprising a polypropylene backing layer, the tensile strength may be in the range of 800 to 1000 N/cm$^2$. Advantageously, the backing layer 101 may comprise a substantially symmetrical bending stiffness in the range of 50 to 300 Nm in both machine and transverse direction. More advantageously, in an abrasive product 100 comprising a polypropylene backing layer 101, the elongation may be in the range of 15 to 125 Nm. The methods used to measure the bending stiffness and film tensile strength and stretch are described below. The values obtained from these tests are shown in Table 2. The tensile properties (tensile strength and bending stiffness or film elongation at break) may be measured according to the international standard ISO 527-3, using a measuring apparatus, for example such as a Lloyd LRX 2K5 tester. Table 2 shows the values of the mechanical properties of PET and PP films of different thicknesses

TABLE 2

Comparison of different properties for polyester (PET) and polypropylene (PP) films measured in machine direction (MD) and in cross direction (CD).

| | PET 75 μm | PET 125 μm | PP 90 μm | PP 110 μm | PP 175 μm |
|---|---|---|---|---|---|
| Bending stiffness MD (Nm) | 43 | 211 | 11-20 | 30 | 122 |
| Bending stiffness CD (Nm) | 60 | 235 | 20 | 27 | 115 |
| Tensile strength (MD) N/mm2 | 2687 | 3513 | 870 | 870 | 870 |
| Tensile strength (CD) N/mm2 | 3481 | 3411 | 770 | 770 | 770 |

The bending stiffness of a material was determined by measuring the bending force in mN when the material was bent exactly 15 degrees in a Lorentzen & Wettre bending tester. The tested material should be conditioned in a climatized room (23±2° C.) at least 3 hours before the test. Before the test the average thickness of the 40×40 mm test strips was measured. The test was repeated two times with two different samples and the bending force was determined in mN. The result was given as an average of the two measurements.

These values for bending stiffness and tensile strength have been shown experimentally to be desirable to obtain a polypropylene backing layer 101 comprising both elastic and plastic properties in a ratio, which provides flexibility for bending and conformability. Further, the stiffness of the abrasive product 100 is appropriate for both machine and hand abrasion, and the abrasive product 100 may be bended in multiple directions $S_x$, $S_y$ and $S_z$ without damaging the backing layer 101 or breaking the abrasive layer 111 due also to the good adhesion of the abrasive layer 111 to the backing layer 101. The selection of a suitable polymeric material such as polypropylene for the backing layer 101 enables the manufacturing of an abrasive product with more flexibility in multiple directions and reduced need for flexing afterwards. For example, an abrasive product 100 comprising a backing layer 100 of polypropylene may be folded multiple times without visible creases for hand abrasion applications.

FIGS. 5, 6 and 7 represent reduced and simple examples of a cross section of an abrasive product 100. The first side 107 (FIGS. 5 and 6) or the surface 110 (FIG. 7) of an abrasive product 100, may comprise surface height deviations in the direction $S_z$.

FIGS. 5 and 6 show a reduced example of a cross-directional structure of the backing layer 101. The backing layer 101 may comprise recessed areas 201, 202, 203 having a depth r1, r2, r3, as shown in FIG. 5. Openings 226 may be provided on the recessed areas 201, 202, 203. Advantageously, the openings 226 are provided such that the distance $h_{op}$ in direction $S_z$ substantially perpendicular to the surface 107, which is the distance of the opening extending through the backing layer 101, is the shortest distance when the openings 226 are positioned adjoined to recessive areas 203. In other words, openings 226 may advantageously be provided to match the recessive areas 203 having the largest depth r3. The flexibility of the backing layer 101 may be further improved by providing a backing layer 101 comprising recessed areas 201, 202, 203.

As shown in FIG. 6, the backing layer 101 may be provided such that a substantially flat functional layer 102 is adjoined to a topmost functional layer 103 comprising surface height deviations in the direction $S_z$. Such surface height deviations may be obtained to the topmost functional layer 103, for example, by moulding or using an engraved cylinder or a calendaring with an inverse pattern. The functional layer 103 may be adjoined, coated or cured against the substantially flat functional layer 102 such that recessed areas 201, 202, 203 having a depth r1, r2, r3 are provided on the surface of the first side 107 of the backing layer 101. Furthermore, in a similar manner, elevated areas 206, surrounded by recessed areas 201, 202, 203 may be provided.

As shown in FIG. 7, the elevated areas 206 may be used to attaching the abrasive layer 111 comprising abrasive zones 118 on the backing layer 101. The abrasive zones 118 may be positioned on elevated areas 206. In addition, or alternatively, the abrasive zones 118 may be naturally elevated to the extent of their thickness $h_{118}$. The abrasive zone 118 may be bounded by the channel portions 221, 222, 223, substantially coinciding with the recessed areas 201, 202, 203. The channel portions 221, 222, 223 or the recessed areas 201, 202, 203 may comprise terraced boundaries. For example, a channel portion 221, 222, 223 having a different height h1, h2, h3 may also have a different width w1, w2. Therefore, the channel portions 221, 222, 223 may comprise different transverse dimensions td1, td2. A first channel portion 201 may have a first transverse dimension td1 and a second channel portion 202 may have a second transverse dimension td2. The second transverse dimension td2 may be larger than the first transverse dimension td1. The transverse dimension td1, td2 which differs between the first channel portions 221 and the second channel portions 222 may be the length L1, L2, the width w1, w2, the height h1, h2, h3. The length L1, L2, width w1, w2 and the height h1, h2, h3 dimensions are substantially perpendicular to each other. The transverse dimension may be substantially constant throughout the channel portion 221, 222. The channel portions 221, 222 and/or the recessed areas 201, 202 may be embossed or formed to the backing layer 101 by a number of methods, such as using cylindrical rolls with engravings or methods such as calendaring, gravure or intaglio printing or pressing. Rotating methods may be advantageous, as the recessed areas may form a repeating pattern, which may be engraved to a cylindrical roll. The flexibility of the backing layer 101 may be improved further by selecting the first transverse dimension td1 of the first channel portions 221. Advantageously, the backing layer 101 is extruded, die cast or injection moulded, and comprises recessed areas, such as first channel portions 221 with a first transverse dimension td1, arranged to improve the abrasive product 100 flexibility. The first channel portions 221 comprise less width than the second channel portions 222. Therefore, the first channel portions 221 enable larger total area of abrasive zones 118 on the abrasive product surface 110. In other words, the first channel portions 221 and the pattern formed by the first channel portions 221 may be used to partition the abrasive layer 111 into abrasive zones 118 with appropriate dimensions. The first channel portions 221 may thus act as hinges, which improve the flexibility of the backing layer 101, without reducing excessively the total area of the abrasive zones 118. In addition, the first channel portions 221 partitioning the abrasive layer 111 into abrasive zones 118 reduce the buckling of the abrasive product 100, as the first channel portions 221 may not comprise an adhesive. Therefore any shrinkage, if any, of the make coat comprising resin 112 and/or size coat 114 when cured occurs in small separate areas and is effectively diminished. A combination of a flexible backing layer 101 and first channel portions 221 may be used to obtain an abrasive product 100 which may not require flexing after curing of the abrasive layer 111 comprising the resin 112.

The examples given provide a method to obtain an abrasive product 100 comprising providing a backing layer 101; and forming multiple abrasive zones 118 supported by the backing layer 101;

wherein each abrasive zone 118 is surrounded by interconnected channel portions 221, 222 having a transverse dimension td1, td2 and the channel portions 221, 222 comprise first channel portions 221 with a first transverse dimension td1 and second channel portions 222 with a second transverse dimension td2 larger than the first transverse dimension td1.

In particular, the transverse dimension td1, td2 may be a width w1, w2 and the second channel portions 222 may be arranged to convey abraded material away from the surface 110. Furthermore, an abrasive product 100 may comprise a polypropylene backing layer 101 and an abrasive layer 111 with a discontinuous coating, such that small abrasive zones 118 may be surrounded by non-abrasive channel portions 201, 202. The flexible backing layer 101 having a discontinuous abrasive coating enables the surface 110 of the product to act in a manner similar to fish scales. Although each abrasive zone may be rigid, the elastic properties of the backing layer 101 provide flexibility for the abrasive zones to move in relation to each other, at least to some extent.

When abrasive products 100 are used, clogging may occur, which refers to the abrasive material accumulating on the surface 110 of the abrasive product 100. Clogging may lead to uneven abrasion quality and/or reduced cutting rate. Water may be used to flush the object surface and the abrasive surface 110. Advantageously, the object surface and the abrasive product surface 110 may be flushed in a continuous manner for abrasion quality to remain good. The flushing should provide sufficient water to convey the abraded material mixed with water away. Further still, water should be provided and retained in sufficient amounts to continue flushing the forming abraded material. When the mixture of water and abraded material, denoted as swarf, is not removed efficiently the abraded material may cause clogging. As the abraded material is mixed into the swarf, the viscosity of the swarf may increase due to insufficient flushing. This in turn may increase friction and cause the surface 110 of the abrasive product to suck against the object surface. To reduce the sucking, the abrasive product surface 110 may be provided with channel portions 221, 222 A way to reduce the clogging is to provide an abrasive product 100 with a surface 110 comprising channels to convey swarf and water to flush the surface 110. In particular, an abrasive product surface 110 may be provided comprising first channels portions 221 to reduce the sucking, and second channel portions 222 to convey the abraded material away. Openings 226 may be provided to convey air and liquids to and from the abrasive surface 110 through the abrasive product in direction $S_z$. The openings may be adjoined to the channels portions 221, 222 providing means to reduce clogging and sucking.

FIG. 8 is an example of a cross-sectional view of an abrasive product 100. The dashed line with C-C markings in FIG. 8 indicates the section C-C of a surface 110 presented in 9. The abrasive product 100, as shown in FIG. 8, may comprise a backing layer 101 and an abrasive layer 111. Optionally, the abrasive product 100 may comprise openings 226 and a foam layer 123. The openings 226 extending through the backing layer 101 and the abrasive layer 111 may be used to convey abraded material away in a controlled manner through the backing layer 101. The foam layer 123 may be adjoined to the second side 108 of the backing layer 101, for example by lamination. The foam layer 123 may be used to provide a better grip for the abrasive product 100. Further, the foam layer 120 may provide a steady and more uniform pressure throughout the abrasive product surface 110, when the abrasive product surface 110 is pressed against an object surface. Further still, the foam layer 120 may comprise a porous structure enabling the layer 123 to absorb or convey liquids. Together with the openings 226, the foam layer 123 may be used for conveying water and swarf away from the surface. When the product is used, the pressure used to hold the product 100 against an object surface may vary. In particular, a product 100 comprising a foam layer 123 and openings 226 may be arranged in a manner similar to a pump, wherein the foam layer 123 may convey water to and from the surface 110 through the openings 226, thereby flushing the surface 110 of the abrasive product 100. The combination of a foam layer 123 and openings 226 may thus be used for washing and cooling of the surface 110. When the diameter of the opening 226 is selected such that loose abraded particles may be conveyed together with water, the arrangement may also provide a method to keep the product surface 110 cleaner. The performance of the of the pumping motion may be controlled by selecting the thickness of the foam layer 123. The foam layer 123 may, depending on the thickness of the foam layer 123, keep various amounts of liquid. By increasing the thickness, the foam layer 123 may absorb larger volumes of liquid than the structure of the abrasive surface 110.

FIG. 9 presents a surface 110 of an abrasive product 100. The surface 110 comprises channels, which separate multiple abrasive zones 118. The channels may be divided into channel portions, such as first channel portions 221 and second channel portions 222. The first channel portions 221 may have a first transverse dimension td1, and the second channel portions 222 may have a second transverse dimension td2. The first transverse dimension td1 may be a width w1, a length L1, as shown in FIG. 10, or a height h1, as shown in FIG. 7. The second transverse dimension td2 may be a width w2, a length L2, as shown in FIG. 10, or a height h2, as shown in FIG. 7. In particular, the first channel portions 221 comprise first channel volumes 10A, 10B and the second channel portions 222 comprise second channel volumes 20A, 20B, which volumes may be determined from the respective width w1, w2, length L1, L2 and height h1, h2 of the channel portion 221, 222. Larger cross-sectional areas convey material and fluids better, therefore advantageously the transverse dimension td1, td2 may also be a two dimensional area defined as the width w1, w2 by height h1, h2 of the channel portion 221, 222. For example, the width w2 by height h2 of the channel portion 222, defined as transverse dimension td2 and may be larger than the width w1 by height h1 of the channel portion 221, defined as transverse dimension td1. The channel portions 221, 222 may preferably comprise curvature. In particular, second channel portions 222 comprising curvature are advantageous in retaining water on the abrasive surface 110. When the surface 110 comprises a network of interconnected channel portions 221, 222 comprising curvature, the movement of water in a single direction is limited by branching and curving channel portions 221, 222. In this respect, the channel portion 221, 222 curvature refers to non-linear extension of the channel portions 221, 222 along the length L1, L2 of the channel portion 221, 222, such as arching or bending. The curvature may also be angular, such as short linear lengths interconnected in an angle. For example, the first channel volumes 10A and 10B are interconnected in an angle. It may be contemplated, that adjacent first channel portions 221 interconnected in an angle may together form a longer first channel portion 221 comprising angularity. FIG. 11 shows an example of a first channel portion 221 separating abrasive zones 118, where the first channel portions 221 are arched and comprise curvature. Alternatively, the channel portions 221, 222 may be linear, but have a maximum linear length L5, as shown in FIG. 12.

A limited linear length of channel portions 221, 222 reduces the risk of interference stripes. Interference stripes may occur when an oscillating apparatus 300 comprising an abrasive product 100 is free spinning and the edge of the abrasive product 100 is pressed hard and kept on the same spot. The oscillating abrasive product 100 may then start to act like a shaft and get a reciprocating movement in the pressed peripheral area. When the reciprocal movement coincides with the direction of the linear channel portions 221, 222, stripes may be formed on the object surface. The risk for interference may be reduced by providing channel portions 221, 222 comprising nonlinear or curved forms. Advantageously, the second channel portions 222 comprise a maximum linear length L5 of less than 2.5 times an oscillation amplitude of an abrasive apparatus 300 compatible with said abrasive product 100, for example less than 2.5 times 2.5 mm, or less than 2.5 times 5 mm, or less than 2.5 times 8 mm. In other words, the oscillation amplitude of an apparatus 300 may be for example 2.5 mm, 5 mm, or 8 mm. The oscillation may be in any direction. By having the linear length less than 2.5 times the oscillation amplitude of apparatus 300, risk of interference may be reduced.

Advantageously, the channel portions 221, 222 are arranged on the surface 110 of the abrasive product 100 in a manner, which allows for flexibility and conformability. At the same time, an efficient flushing of abraded material and retention of water is desired. This may be obtained by providing a backing layer 101 and forming multiple abrasive zones 118 supported by the backing layer 101, wherein each abrasive zone 118 is surrounded by interconnected channel portions 221, 222 having a transverse dimension td1, td2 and the channel portions 221, 222 comprise first channel portions 221 with a first transverse dimension td1 and second channel portions 222 with a second transverse dimension td2 larger than the first transverse dimension td1 arranged to convey abraded material away from the surface 110. The backing layer 101 may comprise one or more functional layers 102, 103, 104, 104, 105, 106, 107, 108 formed by die casting, extruding, co-extruding or injection moulding. Advantageously, the backing layer 101 may comprise a propylene homopolymer or copolymer. The backing layer 101 may be provided with recessed areas 201, 202 for conveying water or abraded material away. The recessed areas 201, 202 and elevated areas 206 may be obtained by continuous moulding of a structure on a flat functional layer 102, 103, 104, 104, 105, 106, 107, 108, filling an engraved structure of a roller or a calendared film with a coating media and bringing the flat functional layer 102, 103, 104, 104, 105, 106, 107, 108, in contact with the filled engraved surface and curing the coating. Advantageously, the coating may be cured simultaneously when bringing the flat functional layer 102, 103, 104, 104, 105, 106, 107, 108, in contact with the filled engraved surface. Alternatively, the desired structure of recessed areas 201, 202 and elevated areas 206 on the surface 110 may also be coated on to the backing layer 101 by screen printing methods. The position of the recessed areas 201, 202 on the backing layer 101 may be arranged to substantially coincide with the position of the second channel portions 222. By having at least part of the recessed areas 201, 202 beneath the second channel portions 222, the volume of the second channel portions 222 may be increased. While the first channel portions 221 are advantageous for flexibility, they may not alone suffice to flush the surface 110. The second channel portions 222 may be arranged to suspend water convey a mixture of water and abraded material and cool the abrasive product surface 110.

In particular, the abrasive product surface 110 may comprise a network of interconnected channel portions 221, 222, which defines an elementary pattern. A non-limiting example of such a network comprising repeating network patterns RNP2 is shown in FIG. 13, where the interconnected second channel portions 222 form repeating patterns RP4 of hexagonal shapes. A non-limiting example of a repeating pattern RP4 is illustrated in FIG. 14, where the first channel portions 221 are connected to the hexagonal shapes formed by the second channel portions 222, defining a network of interconnected channel portions 221, 222.

To avoid sucking, and to obtain a good relation between the abrasion cut rate and efficient flushing, the proportion of the abrasive product surface 110 may comprise abrasive zones 118 in the range of 40% and 80% of the surface 110 area. Advantageously, at least 20% of the surface 110 area is free of abrasive zones 118 to enable formation of a network of channel portions 221, 222 between the abrasive zones 118. When over 50% of the surface 110 area is free of abrasive zones 118, the abrasion effect may diminish to levels which are not sufficient. Further, if more than half of the abrasive product surface 110 does not comprise an abrasive layer 111, the abrasive product may wear down faster than desired. In other words, advantageously the total area of the channel portions 221, 222 is in the range of 20% to 60% of the total area of the abrasive product 100. Most advantageously the total area of the channel portions 221, 222 is in the range of 40% to 50% of the total area of the abrasive product 100. When designing the abrasive surface 110, the use of an abrasive product 100 with an abrasive apparatus 300 should be considered. A typical oscillation amplitude of an abrasive apparatus 300 used with an abrasive product 100 is 2.5 mm, 5 mm, or 8 mm. The oscillation amplitude plays a role in defining the optimal ranges of abrasive zone dimensions, as well as the transverse dimensions of the channel portions 221, 222. Further still, channel portions 221, 222 comprising linear length L1, L2 or width w1, w2 equal to or greater than the oscillation amplitude of an abrasive apparatus 300 increase the risk of linear interference. In other words, the apparatus may begin to resonate or act as a shaft, which may damage the object surface or cause defects in the abraded object surface. To avoid this, the transverse dimensions td1, td2, advantageously the length L1, L2 or width w1, w2, of the channel portions 221, 222 should preferably be less than the oscillation amplitude of the abrasive apparatus 300 used with the abrasive product 100, for example less than 2.5 mm, or less than 5 mm, or less than 8 mm. In particular, the second channel portions 222 advantageously comprise a maximum linear length L5 of less than 2.5 times the oscillation amplitude of an abrasive apparatus 300 used with the abrasive product 100. Further, the use of a surface 110 comprising a network NT1, wherein interconnected channel portions 221, 222 define repeating units, reduces the distance an abraded material has to travel, before it reaches a channel portion 221, 222. For the same reason, to reduce linear interference, the surface area of each abrasive zone 118 should also be considered. The surface area of the abrasive zone may be in the range of 0.5 to 75 square millimeters ($mm^2$). Advantageously, when a grit size is in the range of 3 to 40 micrometers, the area of an abrasive zone 118 may be in the range of 0.5 to 35 square millimeters ($mm^2$), such that the span of an abrasive zone 118 is in the range of 2 to 6 millimeters. In other words, advantageously the abrasive zone 118 surface comprises distances in the range of 2 to 6 millimeters. Advantageously, when the grit size is in the range of 30 to 300 micrometers the area of an abrasive zone 118 may be in the range of 15 to 75 square millimeters ($mm^2$).

It is desirable, that the abrasive product 100, in addition to comprising a surface 110 which does not easily suck to the object surface an being able to retain water sufficiently for precise and high quality abrasion results, could be used in any surface direction with similar abrasion results. In other words, the abrasion product 100 advantageously comprises a surface 110 which enables unidirectional abrasion. This allows the use of the abrasive product without any preferential surface direction. In designing the surface 110 structure, care should be taken to diminish non-abrading areas extending along the surface 110 in a linear direction. For example, if channel portions 221, 222 continue in linear fashion without branching or intersections along multiple abrasive zones 118, parts of the object surface may be abraded less or not at all, causing uneven abrasion results, such as ridges. Furthermore, such linear channel portions 221, 222 may not retain water as well as those with curvature. Further, to improve the flushing of the abrasive surface 110 and conveying of abraded material, each increasing level of channel portions 221, 222 may comprise a total volume at least equal to or larger than the previous level. The total volume in this context refers to the total cross-dimensional surface area of the channel portions 221, 222 defined by the transverse distances td1, td2 in two perpendicular directions, of which at least one is $S_z$. For example, the total volume of the second channel portions 222 is at least the same or larger than the total volume of first channel portions 221. This improves the liquid flow characteristics of the channel portions 221, 222, as each increasing level of channel portions is capable to receive the volume of liquid contained in the preceding channel portion level.

The abrasive zones 118 may be provided by coating with a kiss roll or an engraved roll. By selecting the coating weight suitably, the abrasive material comprising the resin 112 and abrasive grains 113 may be limited to the elevated surfaces 206 only. A suitable coating weight is defined such that the abrasive material may be retained on the elevated areas while cured. When using a flat backing layer 101, the abrasive product surface 110 comprising the channel portions 221, 222 and abrasive zones 118 may be formed by a number of methods, such as coating by cylindrical rolls with engravings or methods such as calendaring, gravure or intaglio printing or pressing. Rotating methods may be advantageous, as the channel portions 221, 222 may form a repeating unit, which may be implemented by a cylindrical roll, for example as a mirror image. Advantageously, the abrasive product surface 110 comprises the channel portions 221, 222 and abrasive zones 118 may be formed by a screen printing apparatus. Screen printing may be used to form single layers or abrasive slurry layers. The screen printing may be used to provide different types of shapes or pattern on the surface 110. The shapes may comprise text, numbers or figures. For example, the pattern may comprise product information, such as a name, number, a barcode, grain size, a logo or any combination of these. The name, number, barcode, grain size, logo or any combination of these, referred to as "information pattern" may be divided into fragments by channel portions 221,222. The division of the information pattern into smaller fragments according to the channel portions 221, 222 improves the behaviour of the information pattern in a manner similar to the other abrasive zones 118 surrounded by the channel portions 221, 222. Further, screen printing may also be used to provide a surface 110 comprising repeating units. Alternatively, screen printing enables printing of an abrasive layer 111 comprising adhesive zones 118 with a self-similar shape. The screen printing method enables a simple way to produce patterns, which may be matched with the recessed areas 201 that may be provided on the backing layer 101.

Alternatively, methods like ink jet printing may be used for applying the resin 112. Ink jet printing may be used such that the resin 112 is printed on the elevated areas 206 only. Advantageously ink jet printing may be used to match the position of the abrasive zones 118 on the elevated areas 206. Further, ink jet printing may provide a method to obtain elevated areas 206 comprising abrasive zones 118 and leaving the channels 221, 222 free of adhesive 113. Furthermore, ink jet printing may provide a method to obtain abrasive zones 118 on a product surface 110 and leaving the recessed areas 201, 202 free of adhesive 113. Further still, although the ink jet printing may be used to print resin 112 over the entire surface 110, the recessed areas 201, 202 may be left unfilled. Advantageously the ink jet printing may be followed by an electrostatic coating of the abrasive grains 113. In electrostatic coating, majority of the abrasive grains 113 is deposited on places where the field tension is highest. On a surface 10 comprising height deviations, the highest field tension in general is on the elevated areas 206.

Recessed areas 201 matching the second channel portions 222 may be provided on the backing layer 101. The position of the recessed areas 201 on the backing layer 101 may substantially coincides with the position of the second channel portions 222 on the abrasive layer 111 to increase the volume of the channel portions 221, 222 and in particular the volume of each increasing level of channel portions, such as the second channel portions 222. In other words, the abrasive layer 111 may be deposited as abrasive zones 118 on the elevated areas 206 in order not to fill the recessed areas 201 provided for channel portions 221, 222 on the backing layer 101. The abrasive layer 111 adjoined to the backing layer 101 may comprise the first channel portions 221, the second channel portions 222 and multiple abrasive zones 118. This is a convenient way to increase the height h1, h2 of the channel portions 221, 222. An alternative way to increase the height h1, h2 of the channel portions 221, 222 would be to provide recessed areas 201 with more depth in the backing layer 101. However, the strength of the backing layer 101 may be reduced by the recessed areas 201, and increased depth may require a backing layer 101 with increased thickness. This in turn may lead to more material used for the backing layer 101, which may increase the production costs of the abrasive product 100.

Openings 226 may be provided on the recessed areas 201 on the backing layer 101 matching the position of the channel portions 221, 222 to improve the flushing or removal of abraded material. FIG. 15 shows an example of an opening 226 comprising a length L3 and a width w3. Advantageously the diameter of the openings 226 is large enough to allow liquid and air to pass. Furthermore, abraded material and water may thus be conveyed through the abrasive product 100 in the direction $S_z$ also from the central parts of the abrasive product surface 110. Advantageously, the surface 110 of an abrasive product 100 may comprise openings 226 extending through the backing layer 101 and the abrasive layer 111 to convey abraded material away. The openings may comprise a maximum opening width w3 equal to the second channel width w2 and a maximum opening length L3 equal to the maximum length L5 of the second channel portions 222. Alternatively, the openings 220 may comprise an opening width w3 equal to or less than the width of the recessed area 116 and a maximum opening length L3 of ten times the width of the width of the recessed area 202, 203. The openings 226 may be circular such that the opening diameter is the opening width w3, said width w3 being equal to the opening length L3. Advantageously the opening diameter is less than the oscillation amplitude of an abrasive apparatus 300. The openings 226 may advantageously be positioned such that they improve the conveying of air, liquid, abraded material or dust from the abrasive product surface 110 through the abrasive product 100. The openings 226 may be provided, for example, when cutting the abrasive product from an abrasive sheet or a web. The openings 226 may comprise length L3 that is arranged to be perpendicular to the length L1, L2 of a channel portion 221, 222. Openings 226 may be provided such that some of the channel portions are covered by the openings 226. However, openings are not needed on each repeating unit. The openings 226 may be perforated on the product 100. The perforation of the openings 226 may be made either before or after the coating of the abrasive layer 111. The perforation, such as punching or die cutting, may also be made by laser light. Laser light is an accurate method to provide the openings 226. Advantageously laser light may be used to burn openings with desired length L3 and width w3 and to match the position of the openings 226 with the position of the channel portions 221, 222 and the recessed areas 202, 203. Advantageously, the openings 226 at least partly interact with the channel portions 221 and 222 to improve the flushing or removal of liquids. Preferably the positions of the openings 226 may be matched with the pattern of the surface 110.

An abrasive product surface may comprise repeating units of abrasive zones 118, where repeating unit boundaries opposite to each other may have congruent curvature to form a complementary pair to fit the repeating units together in a pre-emptying manner. The phrase "repeating units of abrasive zones 118" refers to repeating units which may comprise abrasive zones 118 and that the abrasive zones 118 may be surrounded by channel portions 221, 222. Advantageously, the abrasive zones 118 have congruent shapes in order to obtain channel portions 221, 222 comprising substantially constant widths. The repeating units may vary. Advantageously the repeating units on the abrasive product surface 110 comprise self-similar or a congruent shapes. The repeating unit may comprise an abrasive zone 118 separated by channel portions 221, 222 from another repeating unit. The repeating units may be provided, for example, by designing patterns comprising congruent or self-similar shapes. Congruent in here refers to figures or objects which have the same shape and size. A mirror image of a shape may as well be used when the basic geometric shape is not symmetric. A mirror image of a shape is also congruent to the original shape. Two congruent shapes can be transformed into each other by isometric operations, such as a combination of translations, rotations and reflections. Self-similar shapes refer to shapes which may differ in size but not in shape. Fractals are self-similar patterns, which may be exactly the same at every scale, or nearly the same at different scales. Tessellated shapes refer to shaped created by tessellation, where a two-dimensional surface may be created by using the repetition of a geometric shape with no overlaps and no gap. Tessellation and fractals are advantageous in designing abrasive product surface 110 comprising repeating units, and where linear interference is to be avoided.

An abrasive product surface 110 comprising repeating units which may be fitted together in a pre-emptying manner may be provided from a basic geometric shape. The repeating unit boundary refers to a contact line between two adjacent repeating units. In other words, the boundary is a borderline between two repeating units. The basic geometric shape may be substantially any kind of a geometric shape comprising straight sides and angles, such as a triangle, a quadrangle, a cross or a hexagon. Advantageously the geometric shape may comprise an even number of sides, such that each side has a pair comprising the same length. The basic geometric shape with angles may also be deformed to obtain congruent or self-similar shape comprising curvature. The phrase "pre-emptying manner" refers to the repeating units comprising a congruent shape providing the repeating units with a capability to be fitted together such that the surface 110 may be entirely covered by the repeating units.

Figure 16A:
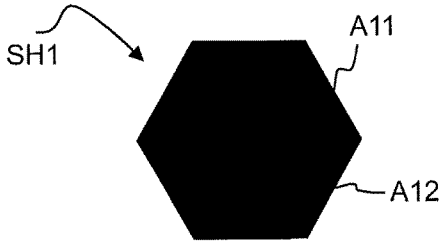
Figure 16B:
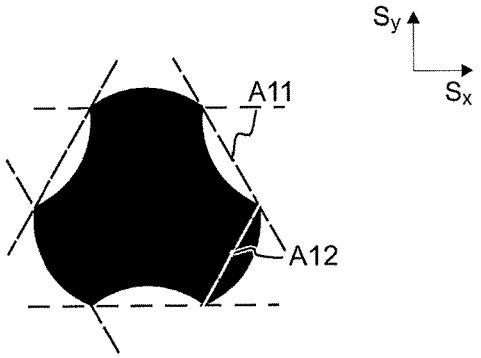
Figure 16C:
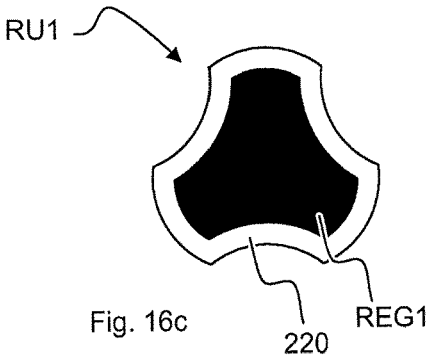
Figure 16D:
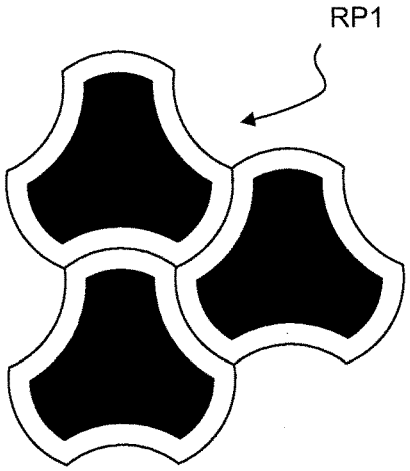
Figure 16E:
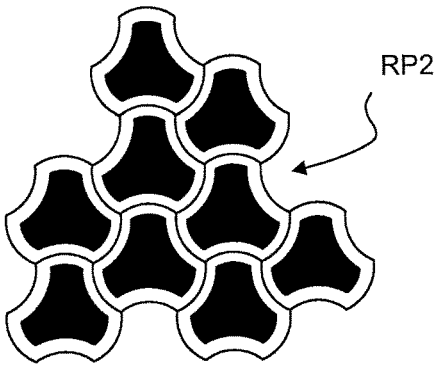

FIGS. 16*a* to 16*f* present non-limiting examples of an abrasive product surface 110 that may be provided on an abrasive product. It is advantageous to create an abrasive zone 118 and channel portions 221, 222 by using shapes denoted as repeating units RU1 that may be fitted together in a pre-emptying manner for filling the whole surface 110 of the abrasive product 100. The repeating unit RU1 may comprise an abrasive zone 118 separated by channel portions 221, 222 from another repeating unit RU1. An abrasive product surface 110 comprising repeating units RU1 which may be fitted together in a pre-emptying manner may be provided from a basic geometric shape SH1, an example of which is shown in FIG. 16*a*. The basic geometric shape SH1 may be deformed, as presented in FIGS. 16*a* and 16*b*, where a hexagonal shape SH1 comprising an even number of sides A11, A12 with matching linear lengths has been deformed by arching the sides A11, A12. The sides A11, A12 are arched in a pairwise manner as shown in FIG. 16*b*, where each pair of sides A11, A12 with matching linear lengths is deformed in a similar manner. The first side A12 of a pair is arched outwards, while the second side A11 of the same pair is arched inwards in a mirror image of the first side. This enables the total area of the geometric shape 226 to remain the same, and provides a pair of two sides A11, A12 comprising congruent curvature. The procedure is then repeated to the remaining pairs of sides. It is not necessary for the basic geometric shape SH1 to be symmetrical. However, advantageously the basic geometric shape SH1 comprises an even number of sides A11, A12 forming pairs. Further, two sides forming a pair have matching linear lengths, which may then be deformed to obtain congruent lines, which are complementary to each other. FIG. 16*c* shows a repeating unit RU1 formed of the deformed geometric shape SH1, where the space 220 for the channel portions 221, 222 may be provided by carving. The carving is advantageously done from the boundary towards the centre of the deformed geometric shape SH1 such, that a substantially constant width from the perimeter of the deformed geometric shape SH1 is deleted. This results to a first area REG1 in the centre of the deformed geometric shape SH1 which may be used to provide the abrasive zones 118. The second area, denoted as space 220, may be used to form the channel portions 221, 222 by adjoining multiple repeating units RU1 formed of the deformed geometric shape SH1 together in a pre-emptying manner leaving no gaps between the repeating units RU1. A repeating unit RU1 comprising a first area REG1 forming an abrasive zone 118 and space 220 forming channel portions 221, 222 surrounding the abrasive zone 118 is shown in FIG. 16*c*. In FIGS. 16*d* and 16*e*, multiple repeating units RU1 are adjoined together such that the repeating units RU1 boundaries are facing each other, leaving no gaps between the, repeating units RU1, and showing the formation of channel portions 221, 222. These multiple repeating units RU1 joined together may be denoted as a repeating pattern RP1, RP2. Repeating patterns may be joined to a repeating network pattern RNP1.

Alternative ways to provide the channel portions 221, 222 and the abrasive zones 118 may be used. FIGS. 17*a* to 17*e* present non-limiting examples of an abrasive product surface 110 that may be provided on an abrasive product 100. An alternative way to provide the channel portions 221, 222 and the abrasive zones 118 may be a shrinking method, where the first area in the centre of the deformed basic geometric shape SH2 may be obtained by shrinking the deformed basic geometric shape SH2 such that the original and shrinked deformed basic geometric shape SH2 are concentric. However, carving is advantageous to provide channel portions 221, 222 comprising a substantially constant channel width w1, w2. The deformed basic geometric shape SH2 may be self-similar to the abrasive zone 118 inside the deformed basic geometric shape SH1. The first area in the centre of the deformed basic geometric shape SH2 may comprise the abrasive zone 118. A non-limiting and exemplary list of basic geometric shapes suitable for deformation comprises hexagons, squares and rhombuses. Advantageously, an abrasive product surface 110 comprises repeating units RU2 of abrasive zones 118, wherein the repeating unit RU2 boundaries opposite to each other have congruent curvature to form a complementary pair to fit the repeating units together in a pre-emptying manner to form repeating patterns RP3, RP4. The repeating pattern RP3, RP4 may form a repeating network pattern RNP2, as shown in FIG. 17*e*. As the shape of the repeating units RU2 or the repeating patterns RP3, RP4 may vary, also the shape of the formed repeating network pattern RNP2. Advantageously the repeating units RU2 on the abrasive product surface 110 comprise self-similar or a congruent shapes. This enables multiple repeating units RU2 to be arranged in a pre-emptying manner for filling the whole surface 110 of the abrasive product 100, as shown in FIG. 17*e*. Repeating units RU2 comprising a periodic shape, a self-similar shape, a fractal pattern or a tessellation may be used for this purpose. An example of a network of repeating network patterns RNP1 comprising curvature is shown in FIG. 16*f*, which also is an example of a network comprising a tessellation.

Figure 16F:
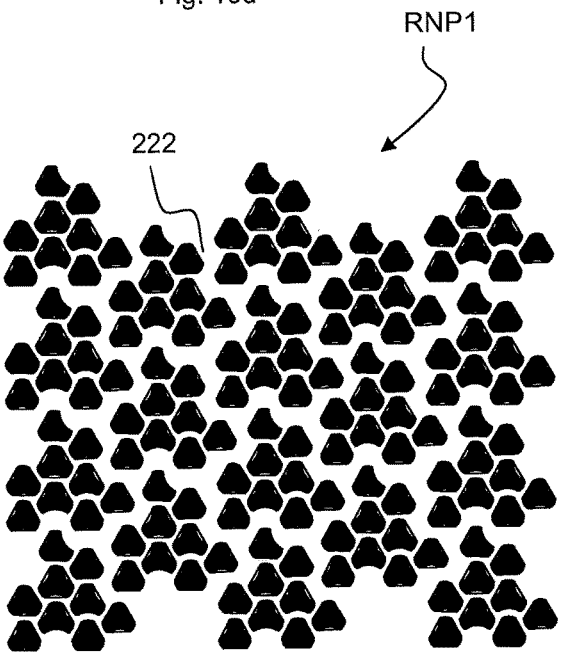

In particular, repeating patterns RP1, RP2 may comprise different amounts of repeating units RU1 such that the repeating network pattern RNP1 may be provided with different pattern, as shown in FIGS. 16*d*, 16*e* and 16*f*.

Further, the repeating pattern RP2 may be the base for the repeating network pattern RNP1 such that the surrounding space 220 of the repeating pattern RP2 may be made wider to form the wider channel 222 in the repeating network pattern RNP1.

Figure 17A:
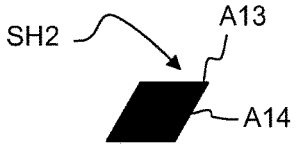
Figure 17B:
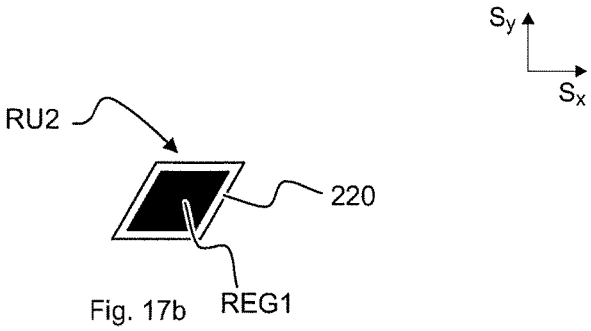
Figure 17C:
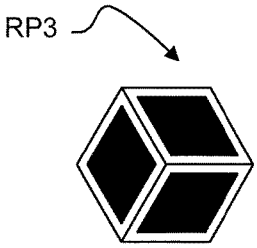
Figure 17D:
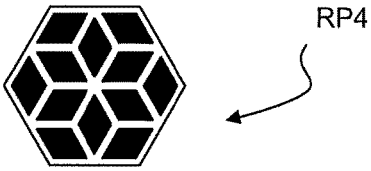
Figure 17E:
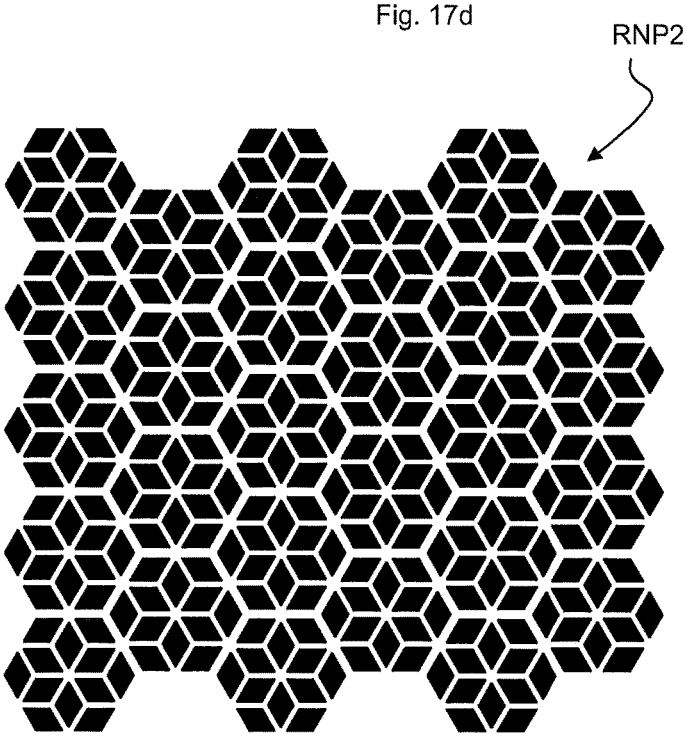

FIGS. 17*a*-17*e* show a non-limiting example where another basic geometric shape SH2 comprising an even number of sides A13, A14, with matching linear lengths may be fitted together in a pre-emptying manner to provide repeating units RU2 without deformation of the basic geometric shapes SH2. In FIG. 17*a*, a rhombus is used as a basic geometric shape SH2 As shown in FIG. 17*b*, the carving of the rhombus may be done in a similar manner as for other basic geometric shapes, and is advantageously done from the boundary towards the centre of the rhombus such that a substantially constant width from the perimeter of the rhombus is deleted. In a manner similar to the carving showed in FIG. 16*c*, the carving of the rhombus, too, results to a first area REG1 in the centre of the rhombus which may be used to provide the abrasive zone 118 and a perimeter, denoted as space 220, surrounding the first area REG1, which perimeter may form channel portions 221, 222. Thus formed repeating unit RU2 may be adjoined to other congruent repeating units RU2 in a pre-emptying manner to form an repeating pattern RP3, RP4 comprising a hexagonal shape, as shown in FIGS. 17*c* and 17*d*. By continuing to fill the abrasive product surface 110 with the repeating units RU2 in a pre-emptying manner, a repeating network pattern RNP2 comprising a self-similar shape to the repeating pattern RP4 may be formed, as shown in FIG. 17*e*. Finally, a network comprising the repeating network patterns RNP2 may be formed, as shown in FIG. 17*e*. In particular, the repeating pattern RP4 and the repeating network pattern RNP2 have the same hexagonal shape at different scales, and the channel portions 221, 222 may comprise volumes which increase respectively at different scales. This is an advantageous way to obtain an abrasive product surface 110 with repeating units and repeating network patterns comprising self-similar shapes at different scales.

Figure 18A:
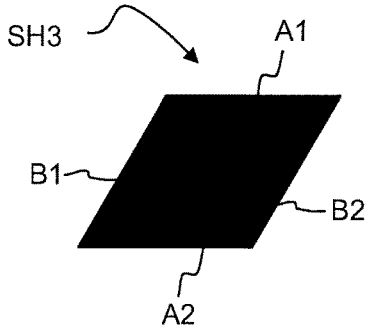
Figure 18B:
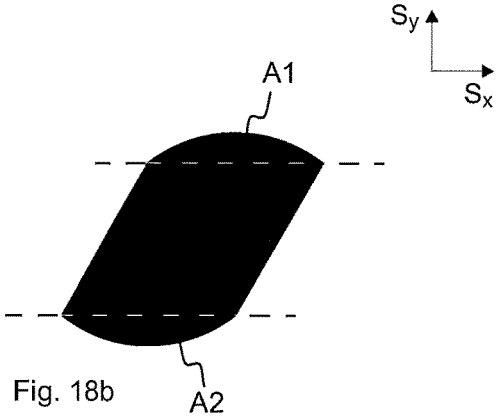
Figure 18C:
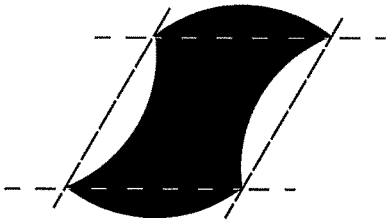
Figure 18D:
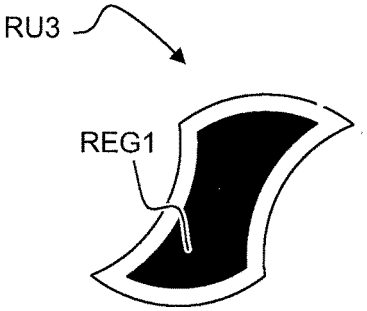
Figure 18E:
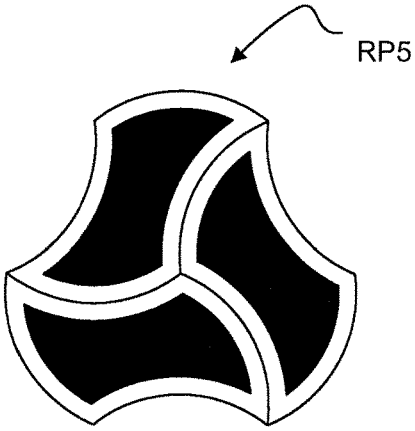
Figure 18F:
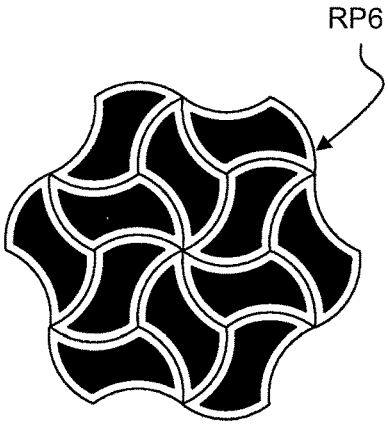
Figure 18G:
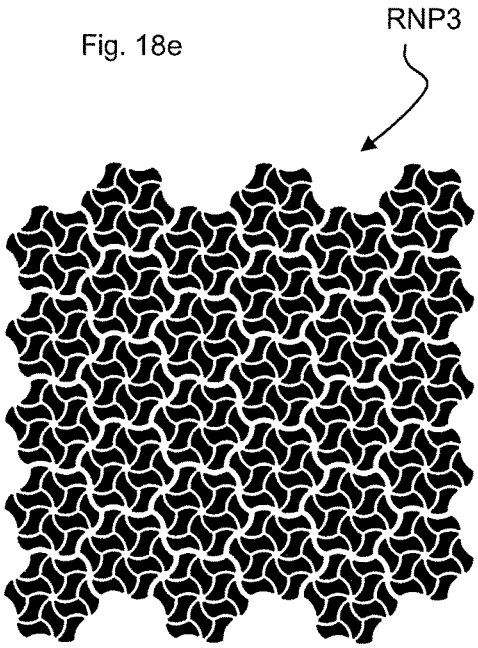
Figure 19A:
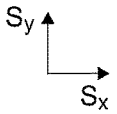
Figure 19A:
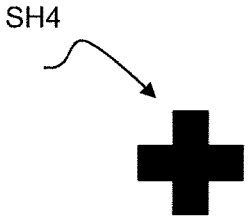
Figure 19B:
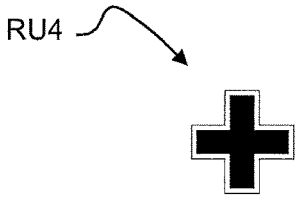
Figure 19C:
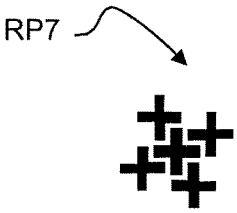
Figure 19D:
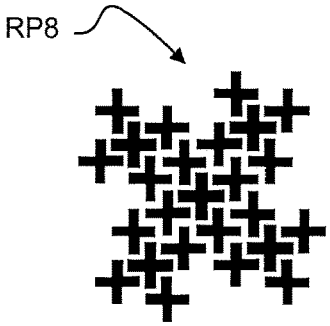
Figure 19E:
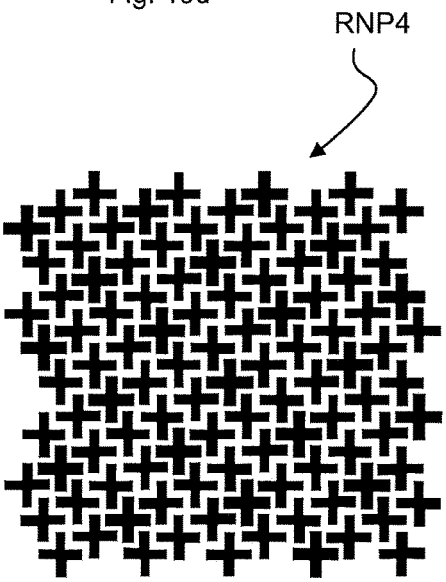
Figure 20A:
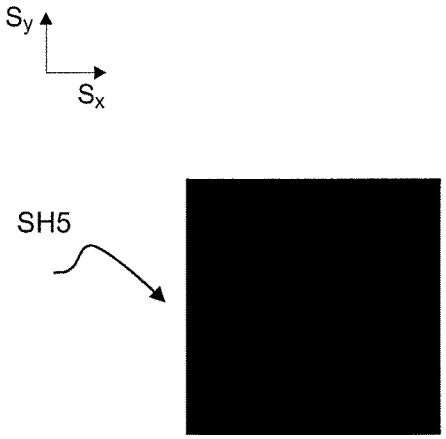
Figure 20B:
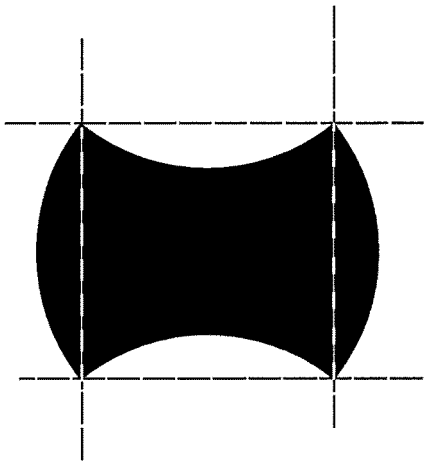
Figure 20C:
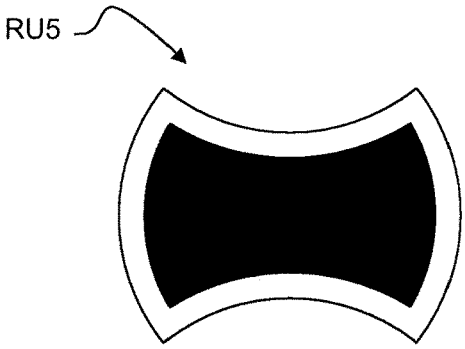
Figure 20D:
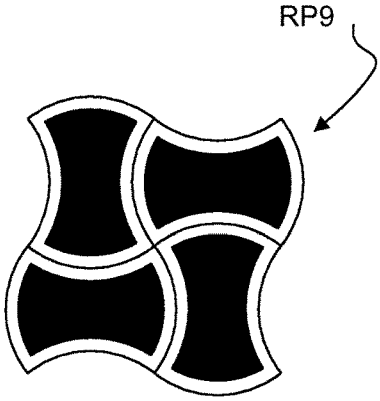
Figure 20E:
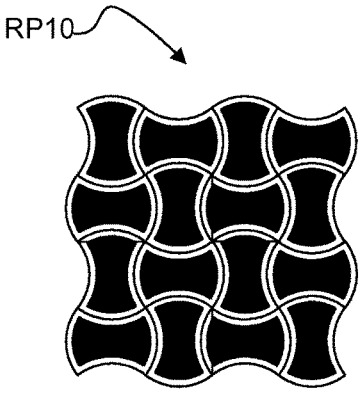
Figure 20F:
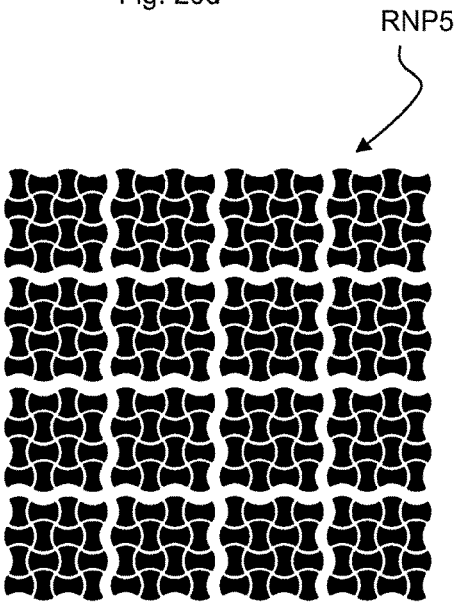
Figures 21A, 21B, 21C, 21D, 21E:
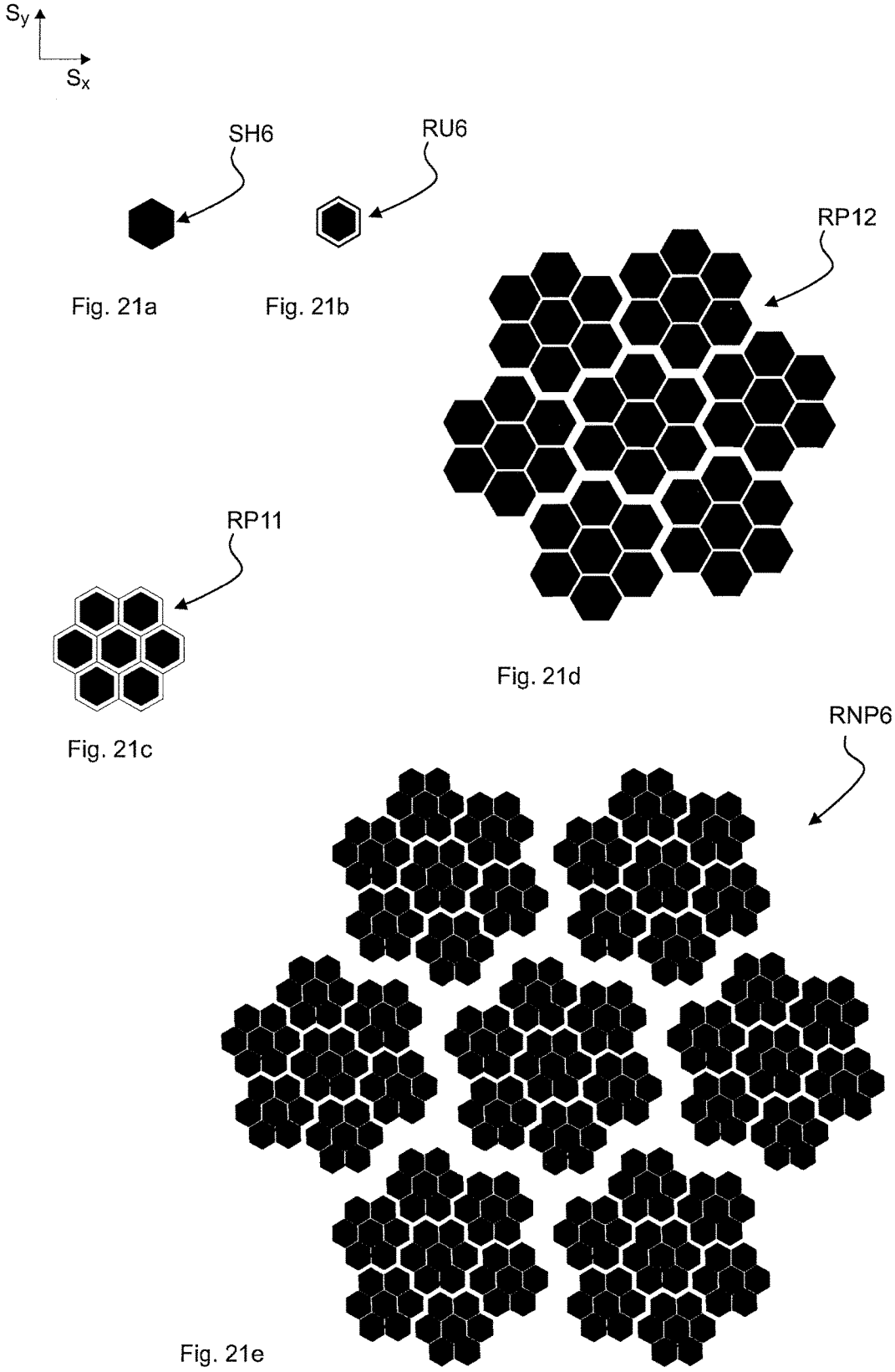

FIGS. 18*a*-18*g* show another non-limiting example where a basic geometric shape SH3 comprising an even number of sides A1, A2, B1, B2 with matching linear lengths may be fitted together in a pre-emptying manner to provide a repeating unit RU3. In FIG. 18*a*, a rhombus is used as a basic geometric shape SH3. The rhombus comprises four sides A1, A2, B1 and B2, of which A1 and B1 form a first pair and A2 and B2 form a second pair of sides. Each pair has sides comprising equal lengths. In other words, the length of A1 equals the length of B1, and the length of A2 equals the length of B2. Each side A1, A2, B1 and B2 may have the same length. FIGS. 18*b* and 18*c* show how the sides A1, A2, B1 and B2 are deformed by arching them in a pairwise manner. For each pair, the first side A1, A2 of the pair is arched outwards, while the second side B1, B2 of the same pair is arched inwards in a mirror image of the first side A1, A2. This enables the total area of the basic geometric shape SH3 to remain unchanged, and provides a pair of two sides A1, B1 and A2, B2 comprising congruent curvature. For a geometric shape comprising more than four sides, the procedure may be repeated to each pairs of sides with matching linear lengths. As shown in FIG. 18*c*, the procedure results to deformed basic geometric shape SH3 comprising curvature. Advantageously each pair is arched in equal amounts, which leads to each side A1, A2, B1 and B2 comprising congruent shapes. Therefore, as shown in FIGS. 18*d* and 18*e*, the repeating unit RU3 provided by deformation of a rhombus may be adjoined to other congruent repeating units RU3 in a pre-emptying manner to form a repeating pattern RP5, as shown in FIG. 18*e*. By continuing to fill the abrasive product surface 110 with the repeating units RU3 in a pre-emptying manner, another repeating pattern RP6 and/or a repeating network pattern RNP3 may be formed, as shown in FIGS. 18*f* and 18*g*. Finally, a network of repeating network patterns RNP3 may be formed, as shown in FIG. 9*f*. Interestingly, the shape of the repeating pattern RP5 is self-similar to the repeating unit RU1 showed in FIG. 16*c*. In particular, when the repeating pattern RP5 and repeating unit RU1 have the same size, they have congruent shapes, and could be adjoined together in a pre-emptying manner. This would lead to a network like RNP3 shown in FIG. 18*g* but with a different configuration of channel portions 221, 222 in the network.

A non-limiting example of a repeating network pattern RNP4 comprising angularity is shown in FIGS. 19*a* to 19*e*, which also is an example of a network comprising a fractal like pattern. In this example, a cross may be used as a basic geometric shape SH4 to obtain a repeating unit RU4. The basic geometric shape SH4 and repeating unit RU4 may comprise the same shape. The basic geometric shape SH4 is similar to the repeating pattern RP7 and to the repeating network pattern RNP4. In this case the network is formed by joining repeating patterns RP8 together in a pre-emptying manner. In particular, the repeating pattern RP8 is formed of a five adjoined units of the repeating pattern RP7. Respectively, the repeating pattern RP7 is formed of a five adjoined repeating units RU4, showing the fractal behaviour of the network comprising repeating units RU4. Another example of a network of repeating network pattern RNP2 comprising angularity is shown in FIGS. 13 and 14, which are also an example of a network comprising fractal behaviour. The repeating network pattern RNP2 comprises a repeating pattern RP4 of hexagonal shapes, which hexagonal shapes may be found in a smaller scale inside the repeating pattern RP4. Angularity may in this context be contemplated as a special example of curvature to avoid linear interference.

FIGS. 20*a* to 20*f* show a further non-limiting example, where a square comprising an even number of sides with matching linear lengths is used as a basic geometric shape SH5 which may be deformed and adjoined to congruent shapes in a pre-emptying manner to provide a network comprising a repeating network pattern RNP5 further comprises repeating units RU5 and repeating patterns RP9, RP10.

FIGS. 21*a* to 21*e* show a still further non-limiting example, where a symmetrical hexagon comprising an even number of sides with matching linear lengths is used as a basic geometric shape SH6, which may be adjoined to congruent shapes in a pre-emptying manner to provide a network comprising repeating units RU6 and repeating pattern RP12 and repeating pattern RP11. The repeating network pattern RNP6 comprises a shape, which is similar in a smaller scale inside the repeating pattern RP12. Further, the repeating network pattern RNP6 may be adjoined to congruent shapes.

FIG. 22 shows a still further non-limiting example, where a non-symmetrical hexagon comprising an even number of sides is used as a basic geometric shape SH7. The sides may be deformed by arching them to obtain a repeating unit RU7, in a pairwise manner similar to what has been described in the example shown on FIGS. 18*a* to 18*g*. The repeating network pattern RNP7 comprises a repeating pattern RP14. The repeating pattern RP14 may comprise two, three or more of repeating patterns RP13 adjoined together in a pre-emptying manner.

The examples described in the FIGS. 16 to 22 may be used as embodiments. In addition the examples described above provide a method to obtain an abrasive product 100 comprising providing a backing layer 101 and forming repeating units RU1, RU2, RU3, RU4, RU5, RU6, RU7 of abrasive zones 118 on the backing layer 101, where the repeating unit RU1, RU2, RU3, RU4, RU5, RU6, RU7 boundaries opposite to each other have congruent curvature to form a complementary pair to fit the repeating units RU1, RU2, RU3, RU4, RU5, RU6, RU7 together in a pre-emptying manner.

Advantageously a quadrangle, such as a square or a rhombus, a symmetrical hexagon or a symmetrical cross may be used as a basic geometric shape SH1, SH2, SH3, SH4, SH5, SH6 for obtaining an repeating unit RU1, RU2, RU3, RU4, RU5, RU6 without deforming the shape. However, the geometric shape SH1, SH2, SH3, SH4, SH5, SH6, SH7 may be deformed. The repeating units RU1, RU2, RU3, RU4, RU5, RU6, RU7 may be adjoined to congruent repeating units RU1, RU2, RU3, RU4, RU5, RU6, RU7 and fitted together in a pre-emptying manner to provide a network of repeating patterns RP1, RP2, RP3, RP4, RP5, RP6, RP7, RP8, RP9, RP10, RP11, RP12, RP13, RP14 comprising curvature. In particular, the same shapes could be obtained by using, for example, a circle as a geometric shape and dividing the perimeter of the circle to an even number of equal lengths to be deformed. The shape of a repeating unit RU1, RU2, RU3, RU4, RU5, RU6, RU7 may be obtained in multiple ways. The carving enables formation of channels, which may be connected to each other. The self-similar shapes further provide a convenient way to form channel portions 221, 222 comprising different widths w1, w2, such as first channel widths w1 and second channel widths w2. Further, a substantially constant width w1, w2 of a channel portion 221, 222 may thus be obtained. By providing the backing layer 101 with recessed areas 201, 202, 203 matching the abrasive product surface 110 pattern, the broader second channel portions 222 may also be made deeper, resulting to an increased volume in the second channel portions 202. The design of channel portions with increasing levels and volumes may also be advantageous to convey loose abrasive grains 113 detached from the abrasive layer 111 efficiently away. When such detached abrasive grains 113 are not removed, they may lead to scratching the object surface. In particular, while the improved volume ratios of the channel portions 221, 222 may remove abrasive material efficiently, the non-linear extension of the channel portions 221, 222 also provides an improved way of retaining water used in wet abrasion. In general, the network NT1 of interconnected channel portions 221, 222 may defines a repeating pattern RP1, RP2, RP3, RP4, RP5, RP6, RP7, RP8, RP9, RP10, RP11, RP12, RP13, RP14. By a substantially constant width w1, w2 of a channel portion 221, 222 it is meant that the repeating unit RU1, RU2, RU3, RU4, RU5, RU6, RU7 is congruent, but the carving of the space 220 may be performed both on the repeating unit and on the repeating patterns RP1, RP2, RP3, RP4, RP5, RP6, RP7, RP8, RP9, RP10, RP11, RP12, RP13, RP14. This provides a convenient method to obtain both first channel portions 221 and second channel portions 222. The width w2 of a channel portion 222 in a larger level or scale of fractality may be widened by positioning the repeating patterns RP1, RP2, RP3, RP4, RP5, RP6, RP7, RP8, RP9, RP10, RP11, RP12, RP13, RP14 more apart from each other. However, when using tessellated shapes where the repeating unit may not symmetrical or comprises curvature, the carving of the space 220 may be performed on repeating patterns RP1, RP2, RP3, RP4, RP5, RP6, RP7, RP8, RP9, RP10, RP11, RP12, RP13, RP14 designed as the largest patterns surrounded by channel portions 222 by carving inside the repeating pattern, Therefore the width w1, w2 along the channel portion 221, 222 may vary in the range of 0 to 30% of the mean width of the channel portion 221, 222.

For the person skilled in the art, it will be clear that modifications and variations of the products according to the present invention are perceivable. The drawings are schematic. The particular examples described above with reference to the accompanying drawings are illustrative only and not meant to limit the scope of the invention, which is defined by the appended claims.

Numbered Items 2.1. An abrasive product 100 comprising a surface 110 with multiple abrasive zones 118 supported by a backing layer 101, each abrasive zone 118 surrounded by interconnected channel portions 221, 222 having a transverse dimension td1, td2, characterized in that the channel portions 221, 222 comprise first channel portions 221 with a first transverse dimension td1 and second channel portions 222 with a second transverse dimension td2 larger than the first transverse dimension td1.

2.2. The abrasive product 100 according to numbered item 1, comprising more than two channel portion 201, 202 levels increasing in transverse dimension.

2.3. The abrasive 100 product according to numbered item 1 or 2, wherein the transverse dimension td1, td2 is substantially constant throughout the channel portion 201, 202.

2.4. The abrasive product 100 according to any of the numbered items 1 to 3, wherein the transverse dimension td1, td2 is width w1, w2 by height h1, h2.

2.5. The abrasive product 100 according to any of the numbered items 1 to 4, wherein the backing layer 101 is extruded, die cast or injection moulded and comprises first channel portions 221 with a first transverse dimension td1 arranged to improve the abrasive product 100 flexibility.

2.6. The abrasive product 100 according to any of the numbered items 1 to 5, wherein second channel portions 222 comprise curvature to avoid linear interference.

2.7. The abrasive product 100 according to any of the numbered items 1 to 6, wherein the second channel portions 222 comprise a maximum linear length L5 of less than 2.5 times an oscillation amplitude of an abrasive apparatus 300 compatible with said abrasive product 100, for less than 2.5 times 2.5 mm, or less than 2.5 times 5 mm, or less than 2.5 times 8 mm.

2.8. The abrasive product 100 according to any of the numbered items 1 to 7, wherein the second channel portions 222 define a network NT1 of interconnected channel portions 221, 222.

2.9. The abrasive product 100 according to numbered item 8, wherein the network NT1 of interconnected channel portions 221, 222 defines a repeating pattern RP1, RP2, RP3, RP4, RP5, RP6, RP7, RP8, RP9, RP10, RP11, RP12, RP13, RP14.

2.10. An abrasive product surface 110 comprising repeating units RU1, RU2, RU3, RU4, RU5, RU6, RU7 of abrasive zones 118, characterized in that repeating unit RU1, RU2, RU3, RU4, RU5, RU6, RU7 boundaries opposite to each other have congruent curvature to form a complementary pair to fit the repeating units RU1, RU2, RU3, RU4, RU5, RU6, RU7 together in a pre-emptying manner.

2.11. The abrasive product surface 110 according to numbered item 10, wherein multiple repeating units RU1, RU2, RU3, RU4, RU5, RU6, RU7 are arranged in a pre-emptying manner for filling the whole surface 110 of the abrasive product 100.

2.12. The abrasive product surface 110 according to numbered item 10 or 11, wherein the repeating units RU1, RU2, RU3, RU4, RU5, RU6, RU7 comprise self-similar or a congruent shapes.

2.13. The abrasive product 100 according to numbered item 1, wherein the area of an abrasive zone 118 is in the range of 0.5 to 75 mm2, and wherein the total area of the channel portions is in the range of 20 to 50% of the total area of the abrasive product 100.

2.14. The abrasive product 100 according to numbered item 1 or 10, wherein the abrasive zones 118 have congruent shapes.

2.15. The abrasive product 100 according to numbered item 10, wherein an abrasive layer 111 adjoined to the backing layer 101 comprises the first channel portions 221, the second channel portions 222 and multiple abrasive zones 118.

2.16. The abrasive product 100 according to numbered item 1 or 10, wherein recessed areas 201, 202, 203 matching the second channel portions 222 are provided on the backing layer 101.

2.17. The abrasive product according to numbered item 16, wherein the position of the recessed areas 201, 202, 203 on the backing layer 101 substantially coincides with the position of the second channel portions 222 on the abrasive layer 111 to increase the volume of the second channel portions 202.

2.18. The abrasive product 100 according to numbered item 1 or 10, comprising openings 226 extending through the backing layer 101 and an abrasive layer 111 with a maximum opening width w3 equal to the second channel width w2 and a maximum opening length L3 equal to the maximum length L5 of the second channel portions 222.

2.19. The abrasive product 100 according to numbered item 1, wherein the second channel portions 222 are arranged to suspend water, convey a mixture of water and abraded material and cool the abrasive product surface 110.

2.20. The abrasive product 100 according to numbered item 1, comprising a flexible abrasive product.

2.21. The abrasive product 100 according to any of the numbered items 1 to 20, comprising a foam layer 123 attached to the backing layer 101 to convey air or liquid.

2.22. The abrasive product 100 according to numbered item 21, wherein the openings 226 are in contact with the foam layer 123 to convey air, liquid or abraded material between the foam layer and the abrasive product surface 110.

2.23. An apparatus 300 comprising an abrasive product 100 according to any of the numbered items 1 to 22.

2.24. Use of an abrasive product 100 according to any of the numbered items 1 to 22 with a fluid comprising water to convey abraded material away.

2.25. Use of an abrasive product 100 according to any of the numbered items 1 to 22 in an apparatus 300 for machine abrasion.

2.26. A method to obtain an abrasive product comprising providing a backing layer 101; and forming multiple abrasive zones 118 supported by the backing layer 101; characterized in that each abrasive zone 118 is surrounded by interconnected channel portions 221, 222 having a transverse dimension td1, td2 and the channel portions 221, 222 comprise first channel portions 221 with a first transverse dimension td1 and second channel portions 222 with a second transverse dimension td2 larger than the first transverse dimension td1.

2.27. A method to obtain an abrasive product 100 comprising providing a backing layer 101; and forming repeating units RU1, RU2, RU3, RU4, RU5, RU6, RU7 of abrasive zones 118 on the backing layer 101, characterized in that the repeating unit RU1, RU2, RU3, RU4, RU5, RU6, RU7 boundaries opposite to each other have congruent curvature to form a complementary pair to fit the repeating units RU1, RU2, RU3, RU4, RU5, RU6, RU7 together in a pre-emptying manner.

2.28. The method according to numbered item 26 or 27, wherein the backing layer 101 comprises one or more functional layers 102, 103, 104, 104, 105, 106, 107, 108 formed by die casting, extruding, co-extruding or injection moulding.

2.29. The method according to numbered item 26 or 27, further comprising increasing the surface tension of the backing layer 101 by a corona treatment.

2.30. The method according to numbered item any of the numbered items 26 to 29, further comprising applying a friction coating to a second side 108 of the backing layer 101

2.31. The method according to any of the numbered items 26 to 30, further comprising providing the backing layer 101 with recessed areas 201, 202, 203 for conveying water or abraded material away.

2.32. The method according to any of the numbered items 26 to 31, further comprising arranging the position of the recessed areas 201, 202, 203 on the backing layer 101 substantially coincide with the position of the second channel portions 222 to increase the volume of the second channel portions 222.

2.33. The method according to numbered item any of the numbered items 26 to 32, further comprising forming openings 226 extending through the backing layer 101, the openings 226 positioned on recessed areas 201, 202, 203 and comprising an opening width w3 equal to or less than the width of the recessed area and a maximum opening length L3 equal to the maximum length L5 of the second channel portions 202.

2.34. The method according to numbered item any of the numbered items 26 to 33, wherein the backing layer 101 comprises a polypropylene homopolymer, a random copolymer of propylene and ethylene or a propylene and an alkene, a block copolymer of propylene and ethylene or alternatively propylene and an alkene.

2.35. The method according to any of the numbered items 28 to 34, wherein a functional layer 102, 103, 104, 104, 105, 106, 107, 108 comprises an adhesion promoting compound selected from the group consisting of high density ethylene copolymer, low density ethylene copolymer, ethylene-butyl acrylate EBA copolymer, ethylene vinyl acetate EVA copolymer, ethylene methyl acrylate EMA copolymer, ethylene butyl acrylate EBA copolymer, 2-ethyl hexyl acrylate 2EHA copolymer, ethylene acrylic ester terpolymer where the acrylic ester type is a methyl, ethyl or butyl acrylate, ethylene vinyl acetate terpolymer where the acrylic ester type is a methyl, ethyl or butyl acrylate.

2.36. The method according to numbered item any of the numbered items 26 to 35, further comprising providing the backing layer 101 with elevated areas 206.

2.37. The method according to numbered item 36, wherein the elevated areas 206 are provided by calendaring the surface of the backing layer 101.

2.38. The method according to numbered item 36, wherein the elevated areas 206 are provided by applying an abrasive coating on a backing layer 101.

2.39. The method according to numbered item 36, wherein the elevated areas 206 are provided by calendaring the surface of the backing layer 101 and applying an abrasive coating on a calendared backing layer 101 surface.

2.40. An abrasive product 100 obtained according to any of the numbered items 26 to 39.

4.1. An abrasive product 100 comprising an abrasive layer 111 adjoined to one side of a backing layer 101, said backing layer 101 comprising at least two functional layers 102, 103, 104, 104, 105, 106, 107, 108.

4.2. An abrasive product 100 comprising a backing layer 101 with a first side 107 and a second side 108, characterized in that an abrasive layer 111 is adjoined to one side of a backing layer 101 comprising polypropylene.

4.3. The abrasive product 100 according to numbered item 2, wherein the polypropylene is a polypropylene homopolymer, a random copolymer of propylene and ethylene or a propylene and an alkene, a block copolymer of propylene and ethylene or alternatively propylene and an alkene.

4.4. The abrasive product 100 according to numbered item 2 or 3, wherein the backing layer 101 comprises one or more functional layers 102, 103, 104, 104, 105, 106, 107, 108.

4.5. The abrasive product 100 according to any of the numbered items 1 to 4, having a functional layer 102, 103, 104, 104, 105, 106, 107, 108 comprising a copolymer of ethylene comprising carboxyl functionality.

4.6. The abrasive product 100 according to any of the numbered items 1 to 5, having a functional layer 102, 103, 104, 104, 105, 106, 107, 108 comprising adhesion promoting compound selected from the group consisting of high density ethylene copolymer, low density ethylene copolymer, ethylene-butyl acrylate EBA copolymer, ethylene vinyl acetate EVA copolymer, ethylene methyl acrylate EMA copolymer, ethylene butyl acrylate EBA copolymer, 2-ethyl hexyl acrylate 2EHA copolymer, ethylene acrylic ester terpolymer where the acrylic ester type is a methyl, ethyl or butyl acrylate, ethylene vinyl acetate terpolymer where the acrylic ester type is a methyl, ethyl or butyl acrylate.

4.7. The abrasive product 100 according to numbered item 6, where the adhesion promoting compound is selected from the group consisting of acid copolymer, sodium ionomer, zinc ionomer, or other metal ionomers such as Surlyn ionomers.

4.8. The abrasive product 100 according to any of the numbered items 1 to 7, wherein the backing layer 101 is formed by extrusion, co-extrusion, injection moulding or lamination.

4.9. The abrasive product 100 according to numbered item any of the numbered items 1 to 8, wherein the backing layer 101 is formed by die casting to diminish orientation of the backing layer 101 in machine direction or transverse direction.

4.10. The abrasive product 100 according to numbered item any of the numbered items 1 to 9, wherein the backing layer 101 comprises a substantially symmetrical tensile strength in the range of 1600 to 5000 N/mm2 in both machine and transverse direction.

4.11. The abrasive product 100 according to numbered item any of the numbered items 1 to 10, wherein the backing layer 101 comprises a substantially symmetrical bending stiffness in the range of 50 to 300 Nm in both machine and transverse direction.

4.12. The abrasive product 100 according to any of the numbered items 1 to 11, wherein the backing layer 101 comprises polypropylene in the range of 20 to 100% of the total polymer weight of the backing layer 101.

4.13. The abrasive product 100 according to any of the numbered items 1 to 12, wherein the abrasive layer 111 comprises a substantially single layer of abrasive grains 113.

4.14. The abrasive product 100 according to any of the numbered items 1 to 13, wherein the backing layer 101 is waterproof.

4.15. The abrasive product 100 according to any of the numbered items 1 to 14, wherein the backing layer 101 comprises recessed areas 201, 202, 203 for conveying water or abraded material away from the abrasive product surface 110.

4.16. The abrasive product 100 according to numbered item any of the numbered items 1 to 15, wherein the abrasive layer 111 comprises channel portions 221, 222 for conveying water or abraded material away from the abrasive product 100 surface 110.

4.17. The abrasive product 100 according to any of the numbered items 1 to 16, comprising openings 226 extending through the backing layer 101, the openings 226 positioned on the recessed areas 201, 202, 203 and comprising an opening diameter less than the oscillation amplitude of an abrasive apparatus 300.

4.18. The abrasive product 100 according to any of the numbered items 1 to 17, comprising a foam layer 123 attached to the backing layer 101 to convey air or liquid.

4.19. The abrasive product 100 according to numbered item 18, comprising openings 226 extending through the backing layer 101, wherein the openings 226 are in contact with the foam layer 123 to convey air, liquid or abraded material between the foam layer 123 and the abrasive product surface 110.

4.20. An apparatus 300 comprising an abrasive product 100 according to any of the numbered items 1 to 19.

4.21. Use of an abrasive product 100 according to any of the numbered items 1 to 19 with a fluid comprising water to convey abraded material away.

4.22. Use of an abrasive product 100 according to any of the numbered items 1 to 19 in an apparatus 300 for machine abrasion.

4.23. A method to obtain an abrasive product 100 comprising providing a backing layer 101 comprising one or more functional layers 102, 103, 104, 104, 105, 106, 107, 108 adjoining an abrasive layer to one side of the backing layer 101

4.24. The method according to numbered item 23, wherein the backing layer 101 is formed by extrusion, co-extrusion, injection moulding or lamination 4.25. The method according to numbered item 23 or 24, wherein the functional layer 102, 103, 104, 104, 105, 106, 107, 108 comprising a copolymer of ethylene comprising carboxyl functionality.

4.26. The method according to any of the numbered items 23 to 25, further comprising increasing the surface tension of the backing layer 101 by a corona, plasma or flame treatment.

4.27. The method according to any of the numbered items 23 to 26, further comprising applying a friction coating to a second side 108 of the backing layer 101.

4.28. The method according to any of the numbered items 23 to 27, further comprising providing the backing layer 101 with recessed areas 201, 202, 203 for conveying water or abraded material away.

4.29. The method according to any of the numbered items 23 to 28, wherein the backing layer 101 comprises a polypropylene homopolymer, a random copolymer of propylene and ethylene or a propylene and an alkene, a block copolymer of propylene and ethylene or alternatively propylene and an alkene.

4.30. The method according to numbered item any of the numbered items 23 to 29, wherein a functional layer 102, 103, 104, 104, 105, 106, 107, 108 comprises an adhesion promoting compound selected from the group consisting of high density ethylene copolymer, low density ethylene copolymer, ethylene-butyl acrylate EBA copolymer, ethylene vinyl acetate EVA copolymer, ethylene methyl acrylate EMA copolymer, ethylene butyl acrylate EBA copolymer, 2-ethyl hexyl acrylate 2EHA copolymer, ethylene acrylic ester terpolymer where the acrylic ester type is a methyl, ethyl or butyl acrylate, ethylene vinyl acetate terpolymer where the acrylic ester type is a methyl, ethyl or butyl acrylate.

The invention claimed is:

1. A flexible abrasive product comprising a surface with multiple abrasive zones supported by a backing layer, the abrasive zones comprising abrasive grains adjoined to a resin, each abrasive zone surrounded by interconnected channel portions with limited linear length having substantially constant transverse dimensions along channel portion lengths, wherein the transverse dimension is width by height, the channel portions comprising different widths such that the channel portions comprise first channel portions with a substantially constant first channel width and second channel portions with a substantially constant second channel width.

2. The abrasive product according to claim 1, comprising more than two channel portion levels such that each increasing level of channel portions comprises a total volume a least equal to or larger than the previous level.

3. The abrasive product according to claim 1, wherein each channel portion has a substantially constant width and height along the channel portion length.

4. The abrasive product according to claim 1, wherein the channel portion length refers to the shortest surface distance between two branching points or intersections of a channel between two abrasive zones.

5. The abrasive product according to claim 1, wherein the backing layer is extruded, die cast or injection moulded and comprises first channel portions with a first transverse dimension arranged to improve the abrasive product flexibility.

6. The abrasive product according to claim 1, wherein second channel portions comprise curvature to avoid linear interference stripes on a surface of an object treated with the abrasive product.

7. The abrasive product according to claim 1, wherein the second channel portions comprise a maximum linear length of less than 2.5 times 8 mm.

8. The abrasive product according to claim 1, wherein the second channel portions define a network of interconnected channel portions.

9. The abrasive product according to claim 8, wherein the network of interconnected channel portions defines a repeating pattern.

10. The abrasive product according to claim 1, wherein the area of an abrasive zone is in the range of 0.5 to 75 $mm^2$, and wherein 20% to 50% of the abrasive product surface area is free of abrasive zones to enable formation of a network of channel portions between the abrasive zones.

11. The abrasive product according to claim 1, wherein the abrasive zones have congruent shapes.

12. The abrasive product according to claim 1, wherein recessed areas matching the second channel portions are provided on the backing layer.

13. The abrasive product according to claim 12, wherein the position of the recessed areas on the backing layer substantially coincides with the position of the second channel portions on the abrasive layer to increase the volume of the second channel portions.

14. An apparatus comprising an abrasive product according to claim 1.

15. A method to obtain a flexible abrasive product, the method comprising providing a backing layer and forming multiple abrasive zones supported by the backing layer, wherein each abrasive zone comprises abrasive grains adjoined to a resin and is surrounded by interconnected channel portions with limited linear length and having substantially constant transverse dimensions along channel portion lengths, wherein the transverse dimension is width by height, the channel portions comprising different widths such that the channel portions comprise first channel portions with a substantially constant first channel width and second channel portions with a substantially constant second channel width.

16. The method according to claim 15, wherein the backing layer comprises one or more functional layers formed by die casting, extruding, co-extruding or injection moulding.

17. The method according to claim 15, further comprising increasing the surface tension of the backing layer by a corona, plasma or flame treatment.

18. The method according to claim 15, further comprising applying a friction coating to a second side of the backing layer.

19. The method according to claim 15, further comprising providing the backing layer with recessed areas for conveying water or abraded material away.

20. The method according to claim 19, further comprising arranging the position of the recessed areas on the backing layer such that the recessed areas substantially coincide with the position of the second channel portions to increase the volume of the second channel portions.

21. The method according to claim 15, further comprising forming openings extending through the backing layer, the openings positioned on recessed areas and comprising an opening width equal to or less than the width of the recessed area and a maximum opening length equal to the maximum length of the second channel portions.

22. The method according to claim 15, wherein the backing layer comprises a polypropylene homopolymer, a random copolymer of propylene and ethylene or a propylene and an alkene, a block copolymer of propylene and ethylene or alternatively propylene and an alkene.

23. The method according to claim 16, wherein one or more of the functional layers comprises an adhesion promoting compound selected from the group consisting of high density ethylene copolymer, low density ethylene copolymer, ethylene-butyl acrylate copolymer, ethylene vinyl acetate copolymer, ethylene methyl acrylate copolymer, ethylene butyl acrylate copolymer, 2-ethyl hexyl acrylate copolymer, ethylene acrylic ester terpolymer where the acrylic ester type is a methyl, ethyl or butyl acrylate, ethylene vinyl acetate terpolymer where the acrylic ester type is a methyl, ethyl or butyl acrylate.

24. The method according to claim 15, further comprising providing the backing layer with elevated areas.

25. The method according to claim 24, wherein the elevated areas are provided by calendaring the surface of the backing layer, by applying an abrasive coating on a backing layer, or by calendaring the surface of the backing layer and applying an abrasive coating on a calendared backing layer surface.

* * * * *